US010017915B2

(12) United States Patent
Aubin-Marchand et al.

(10) Patent No.: US 10,017,915 B2
(45) Date of Patent: Jul. 10, 2018

(54) SUPPORT FRAME FOR AN IMPLEMENT

(71) Applicant: SOUCY INTERNATIONAL INC., Drummondville, Quebec (CA)

(72) Inventors: Jeremie Aubin-Marchand, St-Hugues (CA); Karen Provencher, Drummondville (CA); Michael Bergeron, Drummondville (CA); Tommy Roy, St-Lucien (CA); Normand Roy, St-Hugues (CA)

(73) Assignee: SOUCY INTERNATIONAL INC., Drummondville (CA)

( * ) Notice: Subject to any disclaimer, the term of this patent is extended or adjusted under 35 U.S.C. 154(b) by 435 days.

(21) Appl. No.: 14/628,650

(22) Filed: Feb. 23, 2015

(65) Prior Publication Data

US 2015/0225922 A1 Aug. 13, 2015

Related U.S. Application Data

(63) Continuation of application No. 13/772,661, filed on Feb. 21, 2013, now Pat. No. 9,347,199.

(51) Int. Cl.
*E02F 3/76* (2006.01)
*E01H 5/06* (2006.01)

(52) U.S. Cl.
CPC ..... *E02F 3/7631* (2013.01); *E01H 5/062* (2013.01); *E01H 5/066* (2013.01)

(58) Field of Classification Search
CPC ..... E02F 3/7631; E02H 5/062; A01B 61/044; A01B 61/046; A01B 33/087
USPC ..... 16/281; 37/231
See application file for complete search history.

(56) References Cited

U.S. PATENT DOCUMENTS

| | | | |
|---|---|---|---|
| 271,432 | A | 1/1883 | Diefendorf et al. |
| 301,545 | A | 7/1884 | Wheeler |
| 338,709 | A | 3/1886 | Brown |
| 355,906 | A | 1/1887 | Ady et al. |

(Continued)

FOREIGN PATENT DOCUMENTS

| | | | |
|---|---|---|---|
| CA | 2117823 A1 | 4/1996 | |
| FR | 2284266 A1 * | 4/1976 | ..... A01B 61/044 |

OTHER PUBLICATIONS

English abstract of FR 2284266 retrieved from Espacenet on May 10, 2017.

(Continued)

*Primary Examiner* — Matthew D. Troutman
(74) *Attorney, Agent, or Firm* — BCF LLP

(57) ABSTRACT

A frame for supporting an implement (e.g. a plow) on a vehicle is disclosed. The support frame extends longitudinally and generally comprises, at its rear end, a rear attachment mechanism for removably mounting the support frame to the underside of the vehicle, and at its front end, a front attachment assembly for supporting the implement. The frame comprises a rear section and a front section hingedly connected together such that the front section can pivot upwardly with respect to the rear section. The support frame also comprises a biasing assembly or mechanism, generally comprising a resilient member engaging the front and rear sections, such as to downwardly bias the front portion. By overcoming the downward bias of the biasing assembly, the front section can be further raised with respect to the ground surface, thereby providing greater clearance.

21 Claims, 23 Drawing Sheets

(56) References Cited

U.S. PATENT DOCUMENTS 1,195,271 A 8/1916 Ruth
2,117,148 A * 5/1938 Clark ..... E05D 3/02 14/52
2,134,848 A 11/1938 Anderson
2,144,311 A 1/1939 Klauer
2,144,312 A 1/1939 Klauer
2,144,313 A 1/1939 Klauer
2,144,314 A 1/1939 Klauer
2,216,782 A 10/1940 Klauer
2,532,996 A * 12/1950 Clark ..... A01M 7/0078 16/281
2,614,344 A 10/1952 Harley
3,204,287 A * 9/1965 Gronbach ..... E05F 1/1261 16/288
3,440,739 A 4/1969 Manke
3,643,746 A 2/1972 Dedoes
3,845,577 A 11/1974 Naymik
4,570,367 A 2/1986 Oya
4,615,130 A 10/1986 Racicot
4,800,964 A 1/1989 Rettig et al.
4,825,570 A * 5/1989 Schmid ..... A01B 63/04 172/817
4,843,744 A * 7/1989 Jansen ..... E01H 5/063 37/231
4,860,672 A 8/1989 Zimmerman
4,976,053 A 12/1990 Caley
5,109,618 A * 5/1992 Grubler ..... E01H 5/063 37/232
5,136,795 A 8/1992 Rosenberg
5,195,261 A 3/1993 Vachon
5,615,745 A 4/1997 Cross
5,967,241 A 10/1999 Cross et al.
6,050,008 A 4/2000 Doornek et al.
6,178,668 B1 1/2001 Gustafson et al.
6,178,669 B1 * 1/2001 Quenzi ..... E01H 5/06 172/275
6,202,328 B1 3/2001 Fulton
6,276,076 B1 * 8/2001 Quenzi ..... E01H 5/06 37/231
RE37,628 E 4/2002 Segorski et al.
6,484,421 B1 11/2002 Donogue
6,502,334 B1 1/2003 Davies
6,615,513 B2 * 9/2003 Quenzi ..... E01H 5/06 37/231
6,843,002 B1 1/2005 Moffitt
6,941,685 B2 9/2005 Goy et al.
6,957,505 B1 10/2005 Moffitt
7,028,423 B1 4/2006 Curry
7,093,380 B2 8/2006 Hubscher et al.
7,219,453 B2 5/2007 Baker et al.
7,302,765 B1 12/2007 Jorgenson et al.
7,426,795 B2 9/2008 Raddon
7,975,407 B2 7/2011 Dilworth et al.
8,046,938 B1 11/2011 Jorgenson et al.
8,689,898 B2 4/2014 Benesch
8,763,280 B1 7/2014 Fournier et al.
8,769,847 B2 7/2014 Coulombe et al.
2001/0047600 A1 * 12/2001 Quenzi ..... E01H 5/06 37/270
2002/0088149 A1 * 7/2002 Quenzi ..... E01H 5/06 37/231
2004/0018811 A1 1/2004 Clarkson et al.
2005/0166428 A1 8/2005 Hollinrake et al.
2006/0005433 A1 1/2006 Curtis et al.
2006/0086008 A1 4/2006 Hubscher et al.
2007/0084089 A1 4/2007 Shoemaker
2008/0104865 A1 5/2008 Bailey
2010/0025058 A1 2/2010 Carter et al.
2011/0168417 A1 7/2011 Benesch
2011/0173847 A1 7/2011 Ropog
2011/0225853 A1 9/2011 Dilworth et al.

OTHER PUBLICATIONS

Quadboss UTV Articulating Push Tube Owner's Manual, Aug. 1, 2011, 7 pages, Quadboss, United States.

* cited by examiner

SUPPORT FRAME FOR AN IMPLEMENT

CROSS-REFERENCE TO RELATED APPLICATIONS

The present patent application is a continuation-in-part application of U.S. patent application Ser. No. 13/772,661, entitled "Support Frame for an Implement" and filed at the United States Patent and Trademark Office on Feb. 21, 2013; the content of which is incorporated herein by reference, which claims the benefits of priority of U.S. Provisional Patent Application No. 61/601,086, entitled "Support Frame for an Implement" and filed at the United States Patent and Trademark Office on Feb. 21, 2012; the content of which is incorporated herein by reference.

FIELD OF THE INVENTION

The present invention generally relates to frames and frame assemblies for supporting implements on vehicles and more particularly relates to frames and frame assemblies for supporting implements on small vehicles such as, but not limited to, all-terrain vehicles ("ATV" or "ATVs") and utility-terrain vehicle ("UTV" or "UTVs").

BACKGROUND OF THE INVENTION

All-terrain vehicles ("ATV" or "ATVs"), utility-terrain vehicle ("UTV" or "UTVs"), and other similar vehicles, are often equipped with implements such as plows to allow the vehicles to displace snow, dirt, soil, gravel, etc. Such implements are typically removably mounted to the vehicles via appropriate supporting frames or supporting frame assemblies.

Though several different configurations of supporting frames have been proposed and devised throughout the years, most supporting frames can be categorized either as front-mounted (i.e. mounted to the front of the vehicle) or as underside-mounted (i.e. mounted to the underside of the vehicle).

A front-mounted supporting frame is generally configured to be mounted near or at the front end of the vehicle. Hence, due to its frontal position, the front-mounted supporting frame typically allows the implement to be easily raised when not in use.

However, due to its frontal position, the front-mounted supporting frame is typically less effective at distributing the load that the implement transfers to the vehicle when in use. This is generally caused by the relatively large operating angle of the supporting frame with respect to the frame of the vehicle when the implement is in use.

The underside-mounted supporting frame mitigates some of the shortcomings of front-mounted supporting frames, and more particularly the load distribution problem mentioned above. Indeed, as the underside-mounted frame is mounted underneath the vehicle, typically between the front and rear wheels, the supporting frame defines a smaller operating angle with respect to the frame of the vehicle, and the load generated by the implement is thereby more evenly transferred to the frame of the vehicle.

However, despite the foregoing advantage, an underside-mounted supporting frame typically has less ground clearance than a front-mounted supporting frame since the frame cannot be raised as high as a front-mounted supporting frame. Indeed, in an underside-mounted supporting frame, the supporting frame ultimately abuts on the underside of the vehicle when it is raised by the winch.

There is therefore a need for an improved underside-mounted supporting frame which mitigates at least some of the aforementioned shortcomings.

SUMMARY OF THE INVENTION

At least some of the shortcomings of prior art support frames for implements are mitigated by a support frame which comprises a front section hingedly connected to a rear section and which is downwardly biased by a biasing assembly.

Hence, a support frame for an implement, in accordance with the principles of the present invention, generally extends longitudinally and generally comprises, at its rear end, a rear attachment mechanism for removably mounting the rear end of the support frame to the underside of the vehicle, and at its front end, an implement attachment assembly for supporting the implement.

The rear attachment mechanism typically allows the support frame to pivot with respect to the vehicle, thereby allowing the support frame to be raised and lowered as needed, typically by the winch of the vehicle. In typical though non-limitative embodiments of the support frame, the rear attachment mechanism is a latching mechanism that comprises one or more latches (e.g. two latches).

The support frame also comprises a rear section and a front section hingedly connected thereto. The hinge connection between the front and rear sections is configured to allow the front section to be pivotable between an operative position wherein the front section is substantially not pivoted with respect to the rear section, and an inoperative position wherein the front section is pivoted upwardly with respect to the rear section. Hence, the hinge connection between the front and rear sections generally allows only upward pivotal movements of the front section with respect to the rear section.

The support frame also comprises a biasing assembly or mechanism which downwardly biases the front section into the operative position.

Still, in accordance with the principles of the present invention, the downward bias of the biasing assembly can be overcome, typically by the winch of the vehicle, such as to allow the front section to pivot upwardly with respect to the rear section (i.e. in the inoperative position) in order to provide more clearance between the implement and the ground surface.

In typical though non-limitative embodiments of a support frame, the support frame is configured to support a plow.

In accordance with the principle of the present invention, a support frame for supporting an implement on a vehicle is disclosed. The support frame typically comprises

- a rear end configured to be removably mounted to an underside of the vehicle;
- a front end configured to support the implement;
- the support frame defining a rear section comprising the rear end, pivotally connected to a front section comprising the front end, via a pivot;
- the front section being pivotable between an operative position in which the implement is in use, and an inoperative position; and
- a resilient member, located at least partially into a cavity of the front section or of the rear section adjacent to the pivot for biasing the front section into the operative position.

In accordance with the principle of the present invention, one of the front and rear sections may comprise two arms, wherein each of the two arms has a cavity for receiving the resilient member. In its inoperative position, a portion of the resilient member may extends out of the cavity. Also, the resilient member may be part of a biasing assembly further comprising an abutting surface located adjacent to an extremity of the resilient member and adjacent to the pivot for retaining the resilient member, into the cavity.

In accordance with the principle of the present invention, the biasing assembly may comprise a mounting member for mounting the resilient member inside the cavity and connecting the resilient member to the abutting surface, the mounting member extending between the rear section and the front section.

In accordance with the principle of the present invention, the abutting surface may be perpendicular to at least one of the front and rear sections. Still, the biasing assembly may further comprise a rod and a fastener for operatively connecting the resilient member to the front and rear section. In relation to some other aspects of the invention, the rod may at least partially overlap the pivot.

Yet, according to some other aspect of the present invention, the front section and the rear section may comprise two arms operatively connected, each of the two arms having a cavity for at least partially receiving the biasing assembly with both biasing assemblies biasing the front section into the operative position. The biasing assembly may also at least partially overlap a gap formed between the rear and front sections, the gap being formed when the rear section and the front section pivot between the operative and inoperative positions.

According to some other aspect of the present invention, the biasing assembly in the operative position traverse a plane formed by the pivot axis and a vertical axis perpendicular to the support frame. The resilient member is preferably a coiled spring. The support frame may additionally comprise a rear attachment mechanism at the rear end for removably mounting the support frame to the underside of the vehicle.

Other and further aspects and advantages of the present invention will be obvious upon an understanding of the illustrative embodiments about to be described or will be indicated in the appended claims, and various advantages not referred to herein will occur to one skilled in the art upon employment of the invention in practice. The features of the present invention which are believed to be novel are set forth with particularity in the appended claims.

BRIEF DESCRIPTION OF THE DRAWINGS

The above and other aspects, features and advantages of the invention will become more readily apparent from the following description, reference being made to the accompanying drawings in which:

FIG. 12 is a fragmentary side perspective view of the support frame of FIG. 11.

DETAILED DESCRIPTION OF THE PREFERRED EMBODIMENT

A novel support frame for an implement will be described hereinafter. Although the invention is described in terms of specific illustrative embodiments, it is to be understood that the embodiments described herein are by way of example only and that the scope of the invention is not intended to be limited thereby.

Figure 10A:
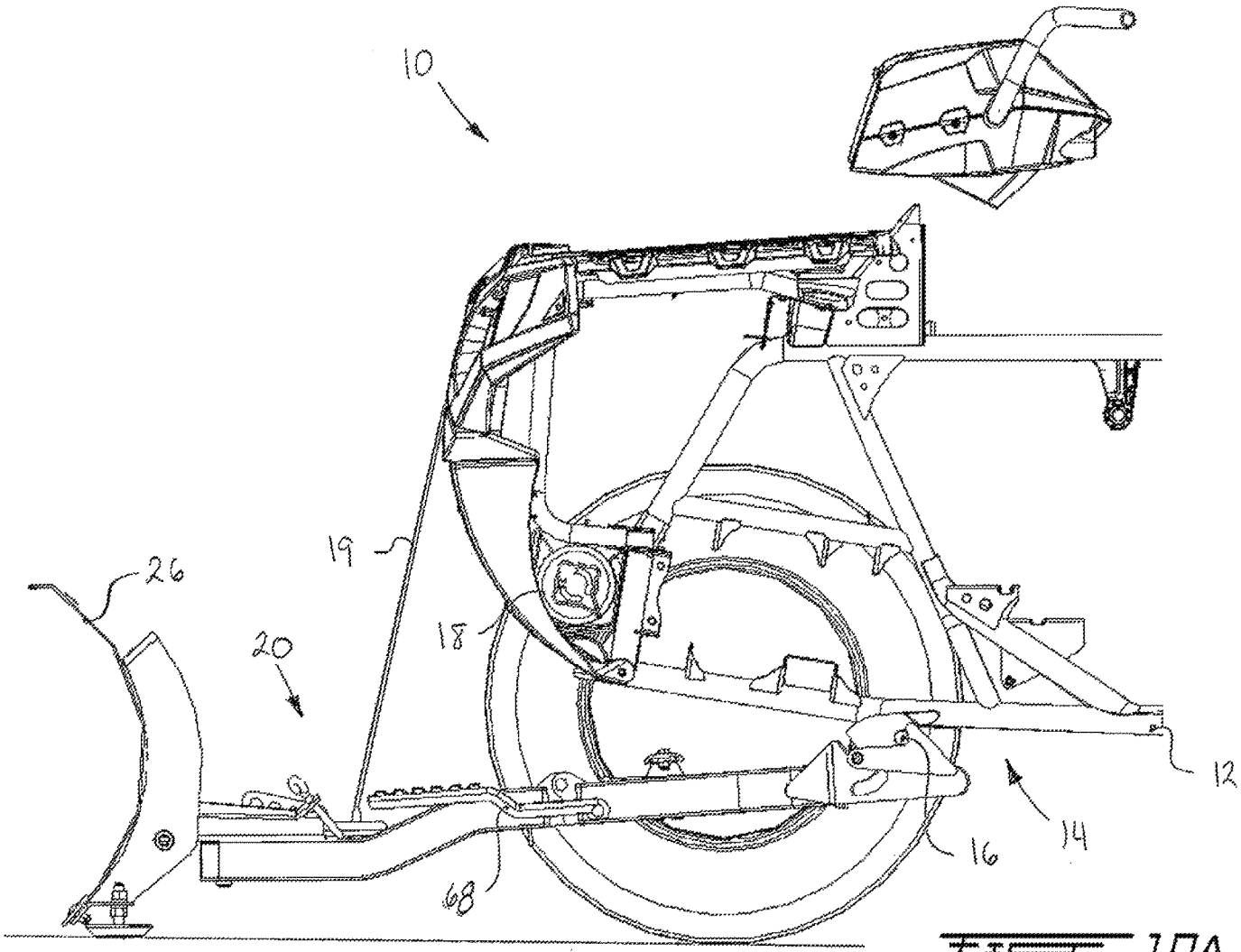
FIGS. 10A to 10C are sequential side views of the support frame of FIG. 1, mounted to an ATV, during the raising of the support frame.
Figure 10B:
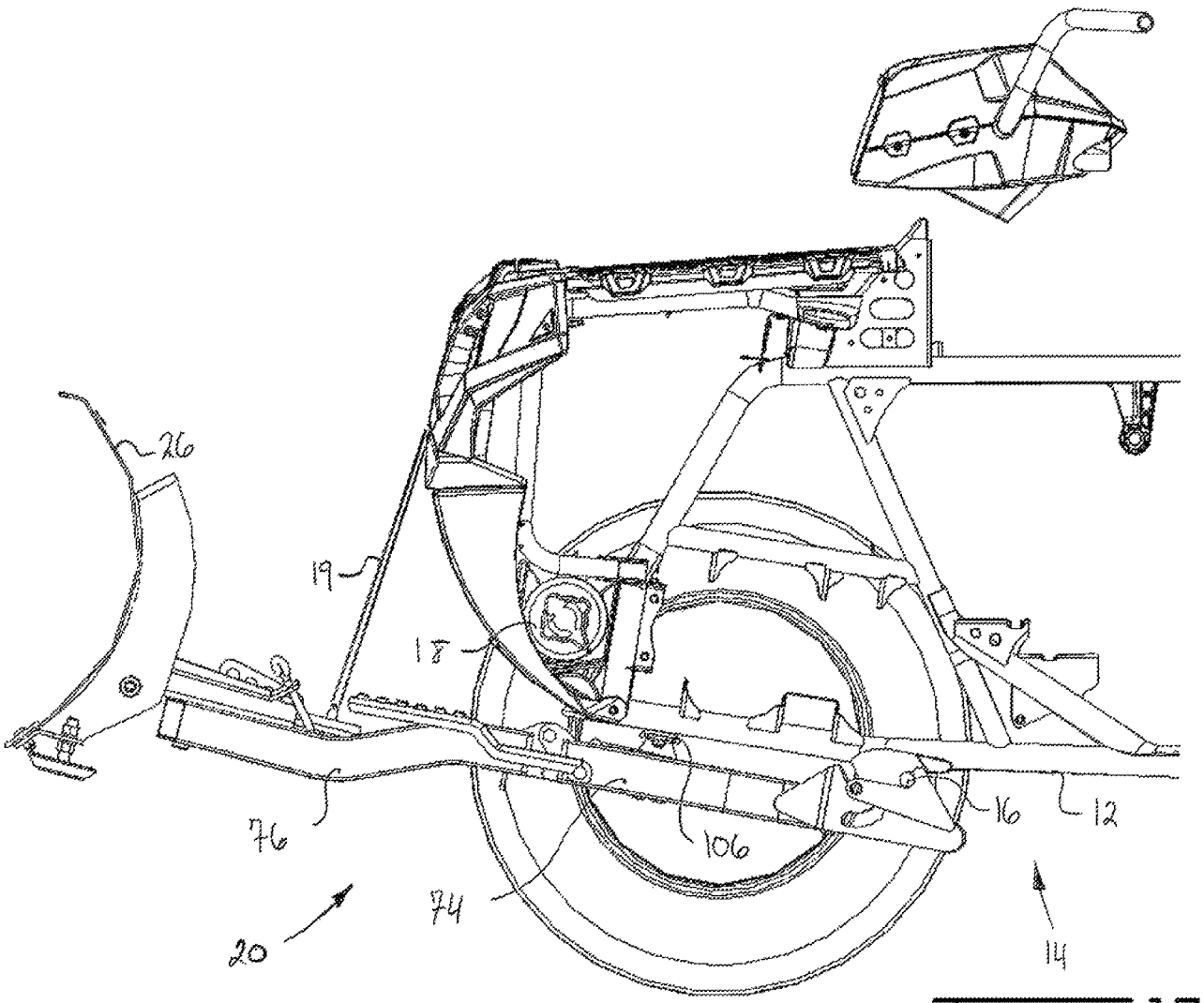
Figure 10C:
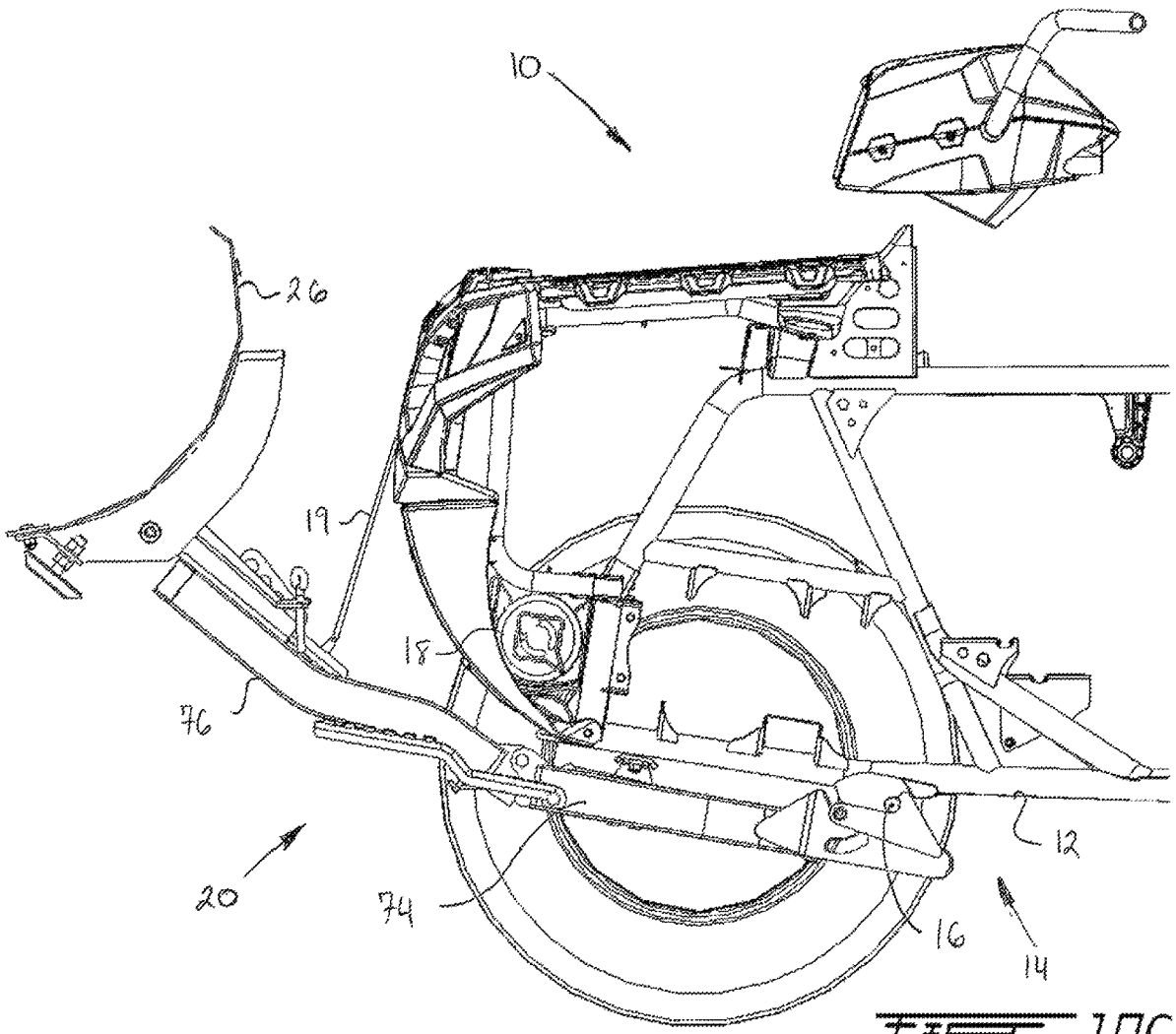
Figure 11:
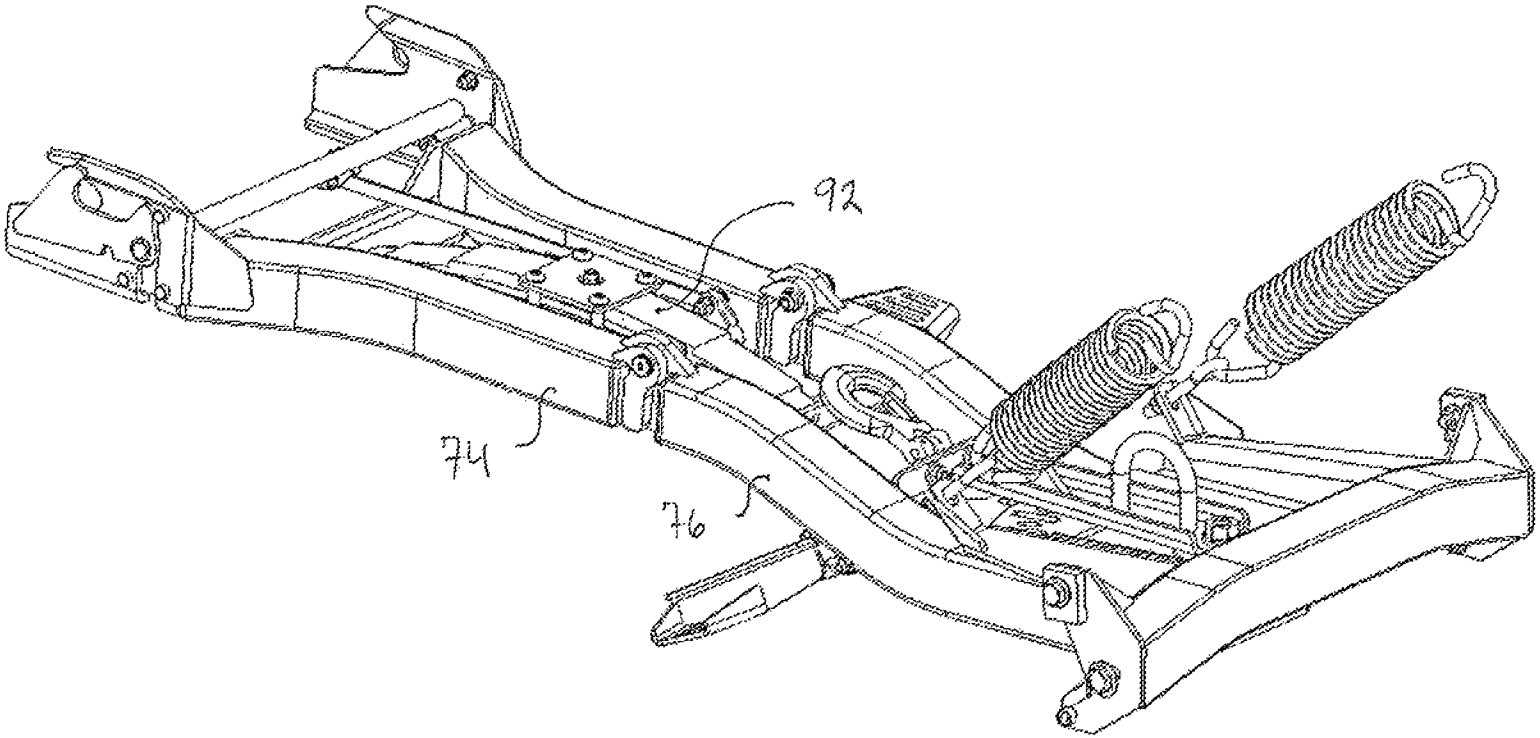
FIG. 11 is a front perspective view of another support frame in accordance with the principles of the present invention.

Referring first to FIGS. 10A to 10C, an embodiment of a support frame 20, in accordance with the principles of the present invention, is depicted mounted to a vehicle 10. In FIGS. 10A to 10C, the vehicle 10 is an ATV. However, the vehicle 10 could be a UTV or any other similar small vehicles.

In the present embodiment, the support frame 20 is pivotally mounted to a mounting rod 16 located on the underside 14 of the frame 12 of the vehicle 10. The mounting rod 16 can be either mounted to the underside 14 of the frame 12 or integral therewith. As it will be best understood below, this pivotal connection between the support frame 20 and the frame 12 allows the implement mounted to the support frame 20 to be lowered toward the ground in a working position (see FIG. 10A), and raised from the ground in an non-working position (see FIGS. 10B and 10C). In other embodiments, the support frame 20 could be mounted to the underside 14 of the vehicle 10 via different attachment mechanisms. However, these other attachment mechanisms must still allow the support frame 20 to pivot with respect to the frame 12 of the vehicle 10. One of such other attachment mechanism is the use of a clevis pin. The clevis pin in another embodiment preferably acts as the pivot from which the frame may pivot with regard to the frame of the vehicle.

Figure 1:
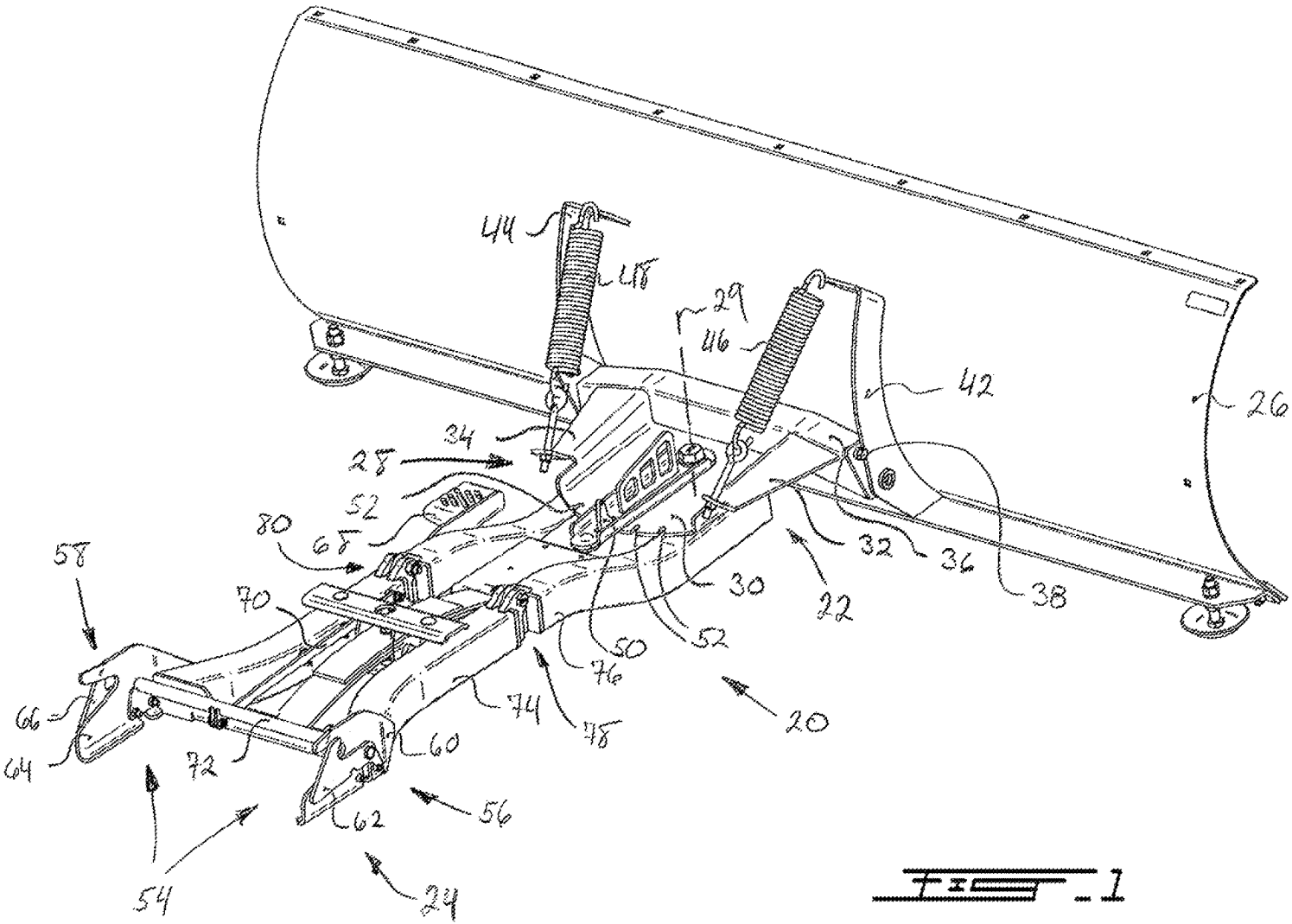
FIG. 1 is a rear perspective view of a support frame in accordance with the principles of the present invention and equipped with a plow.
Figure 2:
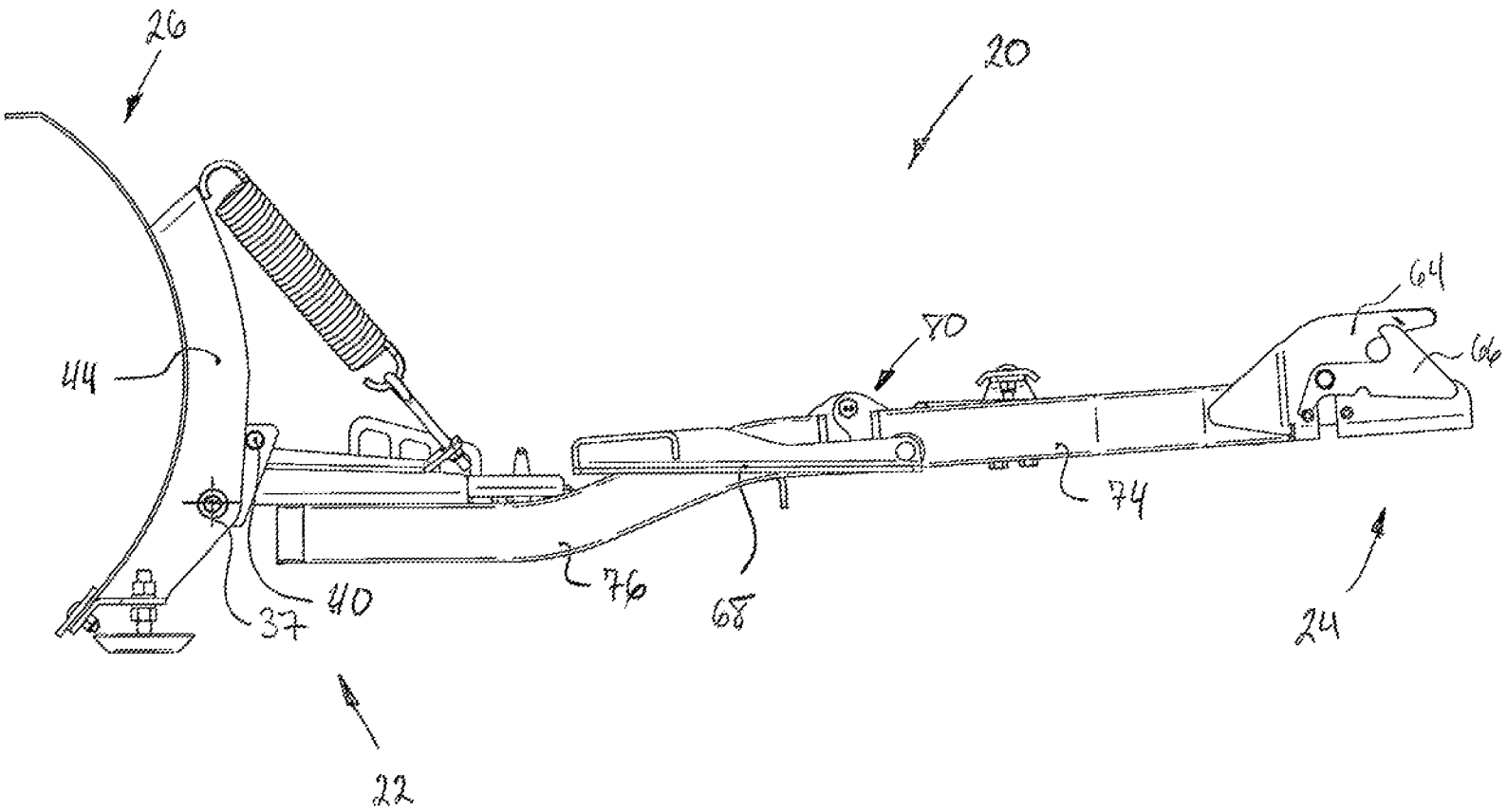
FIG. 2 is a side view of the support frame of FIG. 1.
Figure 3:
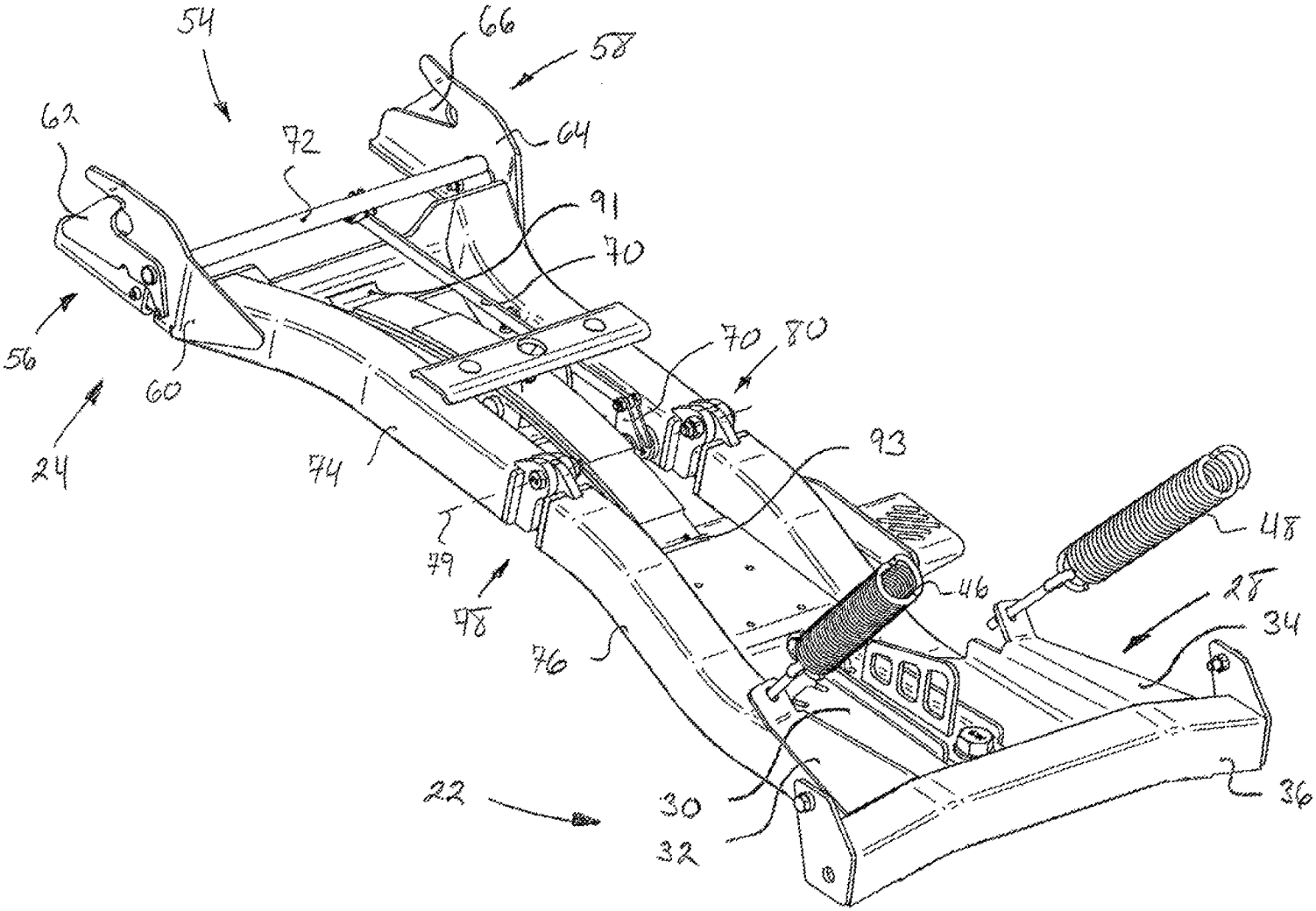
FIG. 3 is a front perspective view of the support frame of FIG. 1, without the plow.

Referring now to FIGS. 1 to 3, the present embodiment of the support frame 20 is shown in greater details.

The support frame 20 generally has a front end 22 and a rear end 24. The front end 22 is configured to support an implement. In the present embodiment, the implement is a plow 26 of typical configuration. In that sense, it is to be understood that the support frame 20 would typically be used to support a plow 26. However, the support frame 20 is not limited to supporting a plow 26 and could therefore support other types of implements.

To properly secure the plow 26 to the front end 22, the support frame 20 generally comprises an attachment plate 28 which is pivotally mounted to the support frame 20, near or at the front end 22. This attachment plate 28 comprises a base portion 30, two lateral wing-shaped portions 32 and 34 extending laterally and upwardly from the base portion 30, and a frontal portion 36 located at the forward extremity of the base portion 30 and of the lateral portions 32 and 34.

As best shown in FIGS. 1 and 2, the plow 26 is pivotally mounted to the frontal portion 36 such as to be pivotable along a substantially horizontal axis 37 (see FIG. 2). However, the frontal portion 36 comprises side stoppers 38 and 40 on which the two back ribs 42 and 44 of the plow 26 can respectively abut to limit the rearward pivotal movements of the plow 26. To limit the forward pivotal movements of the plow 26, a pair of springs 46 and 48 are respectively mounted between the back ribs 42 and 44 and the lateral portions 32 and 34. The springs 46 and 48 generally allow the plow 26 to temporarily pivot forwardly when the plow 26 encounters an obstacle.

The attachment plate 28 is pivotally mounted to the support frame 20 such as to be pivotable along a substantially vertical axis 29 (see FIG. 1). The pivotal movements of the attachment plate 28 allow the angle of the plow 26 to be adjusted with respect to the general longitudinal direction of the support frame 20. In the present embodiment, the angle of the plow 26 can be adjusted via the interaction of an actuatable spring-loaded locking lever 50 and a series of angularly disposed notches 52 formed at the rear extremity of the attachment plate 28 (see FIG. 1).

To adjust the angle of the plow 26, the lever 50 is removed from its current notch 52, the attachment plate 28 is pivoted until the desired angular notch 52 is aligned with the lever 50, and then the lever 50 is inserted into the new notch 52 to lock the attachment plate 28, and thus the plow 26, in its new angular position.

Referring now to FIGS. 1 to 6, the rear end 24 of the support frame 20 comprises a rear attachment mechanism 54 which is configured to pivotally engage the mounting rod (or rods) 16 located underneath the vehicle 10 (see FIGS. 10A to 10C).

In the present embodiment, the rear attachment mechanism 54 is a latching mechanism and comprises two latches 56 and 58 mounted on each side of the support frame 20 near or at the rear end 24. Latch 56 comprises a fixed side plate 60 and a hook-shaped member 62 pivotally mounted thereto. The member 62 is biased into a locked position, i.e. the position shown in the figures, by a biasing member such as a spring (not shown). Similarly, latch 58 comprises a fixed side plate 64 and a hook-shaped member 66 pivotally mounted thereto. The member 66 is also biased into a locked position, i.e. the position shown in the figures, by a biasing member such as a spring (not shown).

Understandably, as the latches 56 and 58 are pushed against the mounting rod 16 during the installation of the support frame 20 on the vehicle 10, the mounting rod 16 will force the members 62 and 66 open. The biasing members will then force the members 62 and 66 in their locked position when the mounting rod 16 is fully inserted into the latches 56 and 58 (see FIGS. 10A to 10C).

The members 62 and 66 can also be pivoted in an unlocked position by an unlocking actuating device 68 (e.g. a pedal that can be depressed by the user) operatively connected to the members 62 and 66 via a linkage assembly 70 and a laterally extending rod 72 fixedly connected to the members 62 and 66.

As indicated above, the pivotal connection between the latches 56 and 58 and the mounting rod 16 allows the support frame 20 to be lowered and raised. This is typically done with the assistance of a winch 18 (and its cable 19) mounted at the front of the vehicle 10 (see FIGS. 10A to 10C).

In other embodiments, the rear attachment mechanism could be different. Still, the rear attachment mechanism needs to allow the support frame 20 to pivot with respect to the frame 12 of the vehicle 10 in order for the support frame 20 to be lowered and raised.

In accordance with the principles of the present invention, the support frame 20 comprises a rear portion 74 and a front portion 76 pivotally mounted thereto. As it will be best understood below with reference to FIGS. 10A to 10C, the front portion 76 can pivot upwardly with respect to the rear portion 74 in order to provide greater ground clearance when the plow 26 is not in use.

In the present embodiment, the rear portion 74 and the front portion 76 are pivotally connected by a pair of hinges 78 and 80 which define a substantially horizontal rotation axis 79 (see FIG. 3). In other embodiments, the rear portion 74 and the front portion 76 could be pivotally connected by only one hinge or by more than two hinges.

Figure 7:
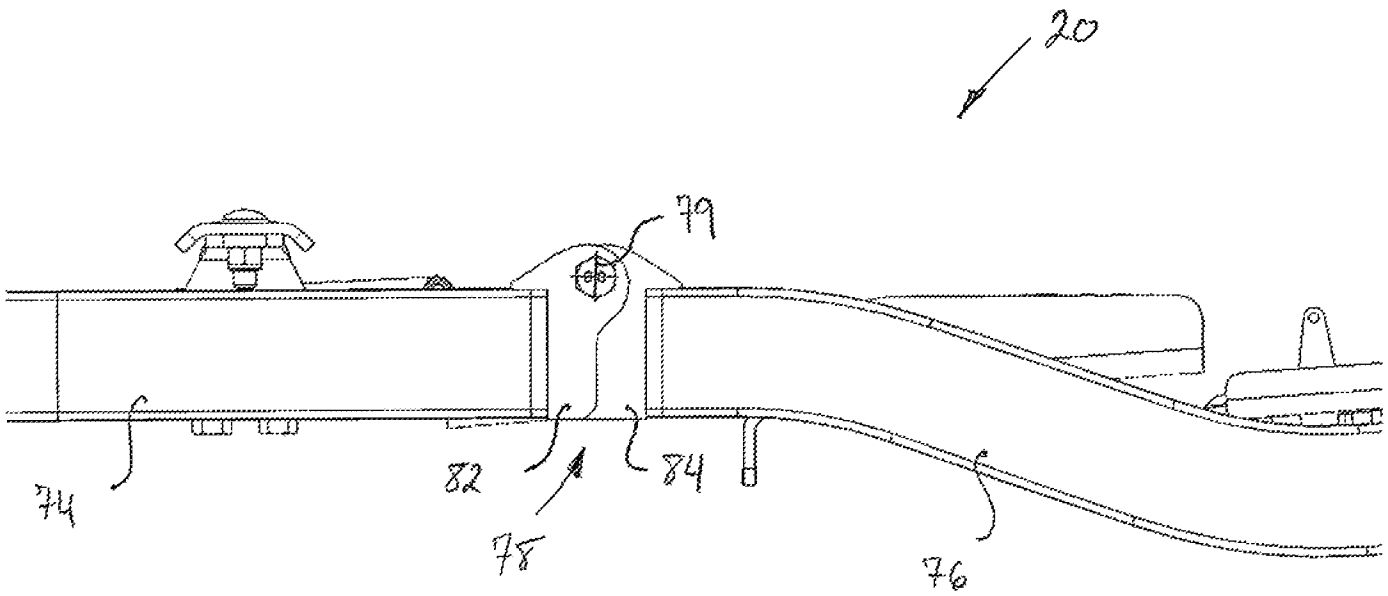
FIG. 7 is a partial side view of the support frame of FIG. 1.
Figure 8:
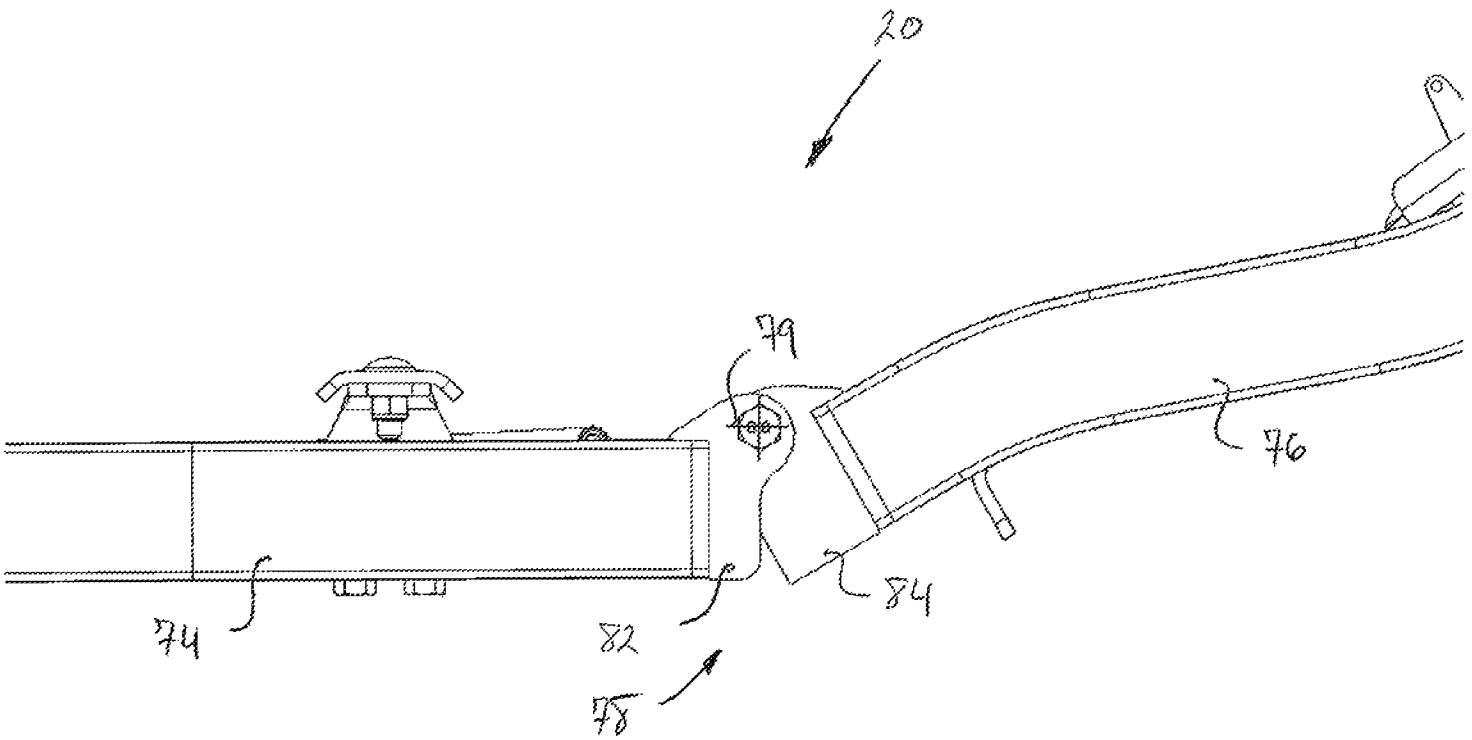
FIG. 8 is another partial side view of the support frame of FIG. 1.
Figure 9:
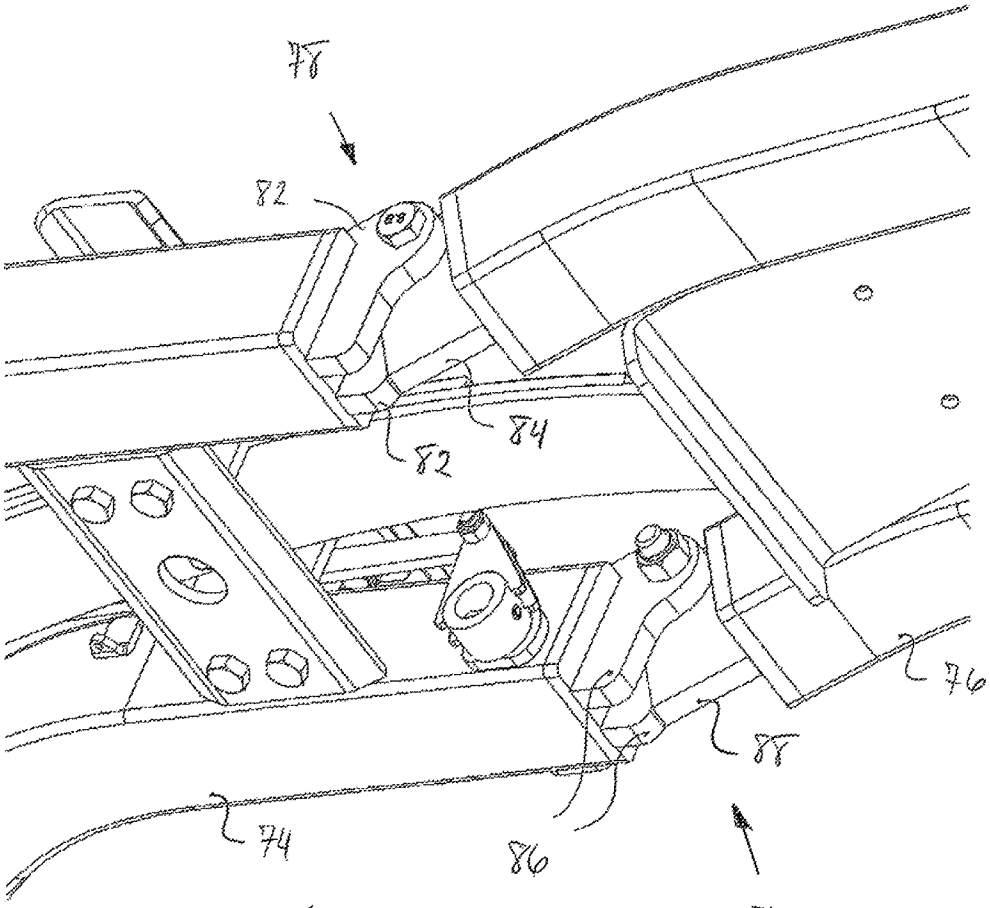
FIG. 9 is a partial bottom perspective view of the support frame of FIG. 1.

Referring now to FIGS. 7 to 9, from an operative position of the front portion 76 (see FIG. 7), the hinges 78 and 80 are configured to allow only upward pivotal movements of the front portion 76 with respect to the rear portion 74, i.e. to an inoperative position (see FIG. 8). In that sense, the rotation axis 79 of the hinges 78 and 80 is located in the upper portion of the hinges 78 and 80 (see FIGS. 7 and 8).

The hinge 78 comprises complementary hinge members 82 and 84 which are respectively secured to the rear portion 74 and to the front portion 76. In the present embodiment, the hinge member 84 is configured to abut on the rear portion 74 when the hinge 78 is closed and thus when the front portion 76 is in its operative position (see FIG. 7). Hence, hinge member 84 prevents the front portion 76 from pivoting downwardly with respect to the rear portion 74. Hinge 80 similarly comprises complementary hinge members 86 and 88 which are respectively secured to the rear portion 74 and to the front portion 76. Hinge 80 functions as hinge 78.

Referring back to FIGS. 3 to 6, to prevent the front portion 76 from freely pivoting upwardly with respect to the rear portion 74, the support frame 20 comprises a biasing assembly 90 which normally biases the front portion 76 in its operative position, i.e. with the hinges 78 and 80 in closed position.

In the present embodiment, the biasing assembly 90 is mounted to the rear portion 74 and generally comprises a leaf spring 92 (i.e. a resilient member) which longitudinally extends between a rear supporting member or plate 94, mounted to the rear portion 74, and a front supporting member or plate 96, mounted to the front portion 76. Still, in the present embodiment, the extremities 91 and 93 of the leaf spring 92 are not secured to the rear supporting plate 94 and to the front supporting plate 96. In fact, the extremities 91 and 93 of the leaf spring 92 respectively rest on the supporting plates 94 and 96 such that they are substantially free to slide on the supporting plates 94 and 96 when the front portion 76 is upwardly pivoted with respect to the rear portion 74.

Figure 6:
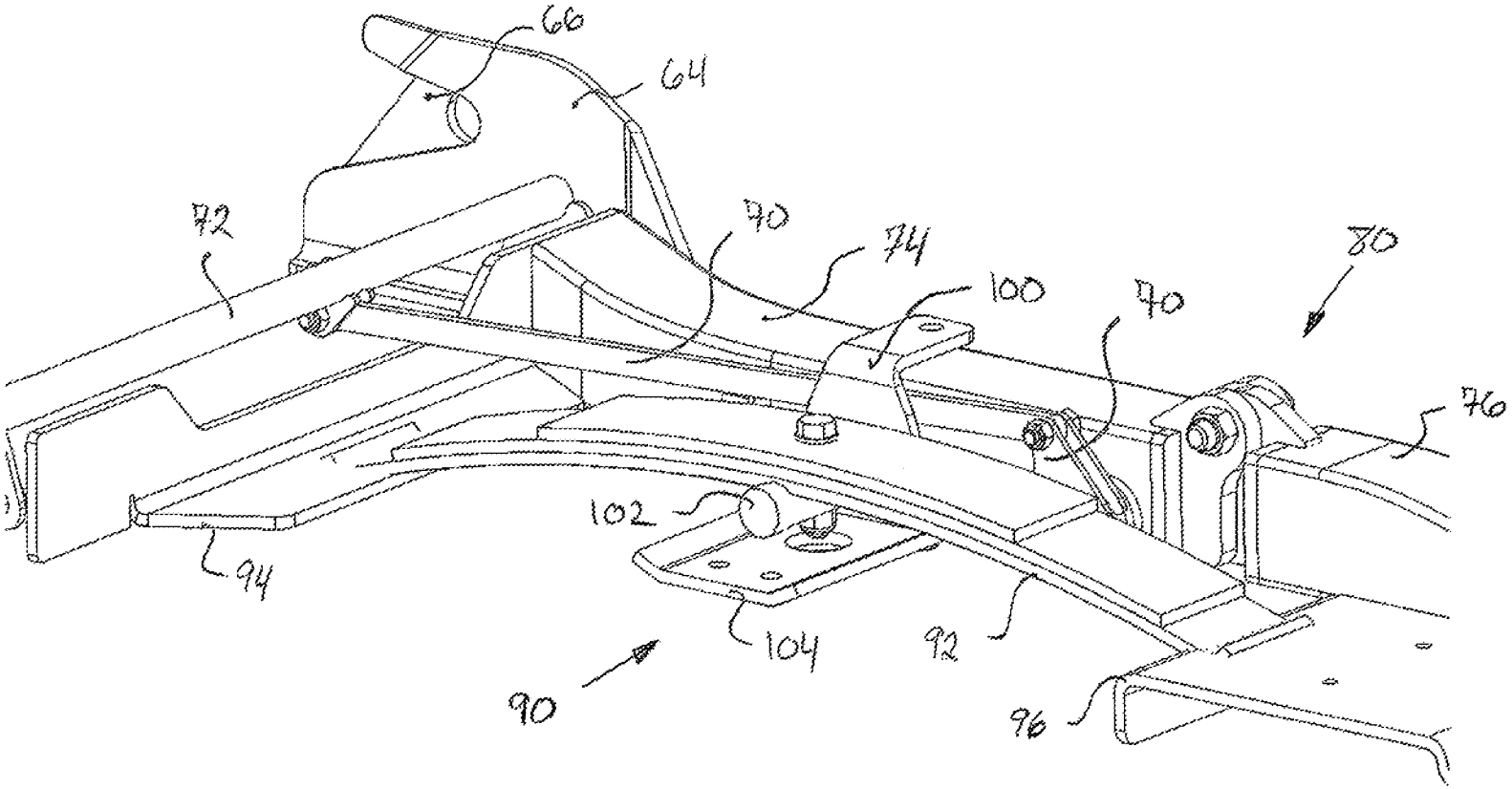
FIG. 6 is another fragmentary side perspective view of the support frame of FIG. 1.

In the present embodiment, the leaf spring 92 is further pivotally mounted to a pair of supporting brackets 98 and 100 via a rod or shaft 102 which is pivotally mounted to the brackets 98 and 100. As illustrated in FIG. 6, in the present embodiment, the leaf spring 92 is secured to the shaft 102 with a fastener (e.g. a bolt and a nut). In other embodiments, the leaf spring 92 could be secured to the shaft 102 using other method such as, but not limited to, welding. In the present embodiment, the resilient member preferably extends from the rear section to the front section beyond a transversal plane defined by the connection pivotally connecting the front and rear sections.

Figure 4:
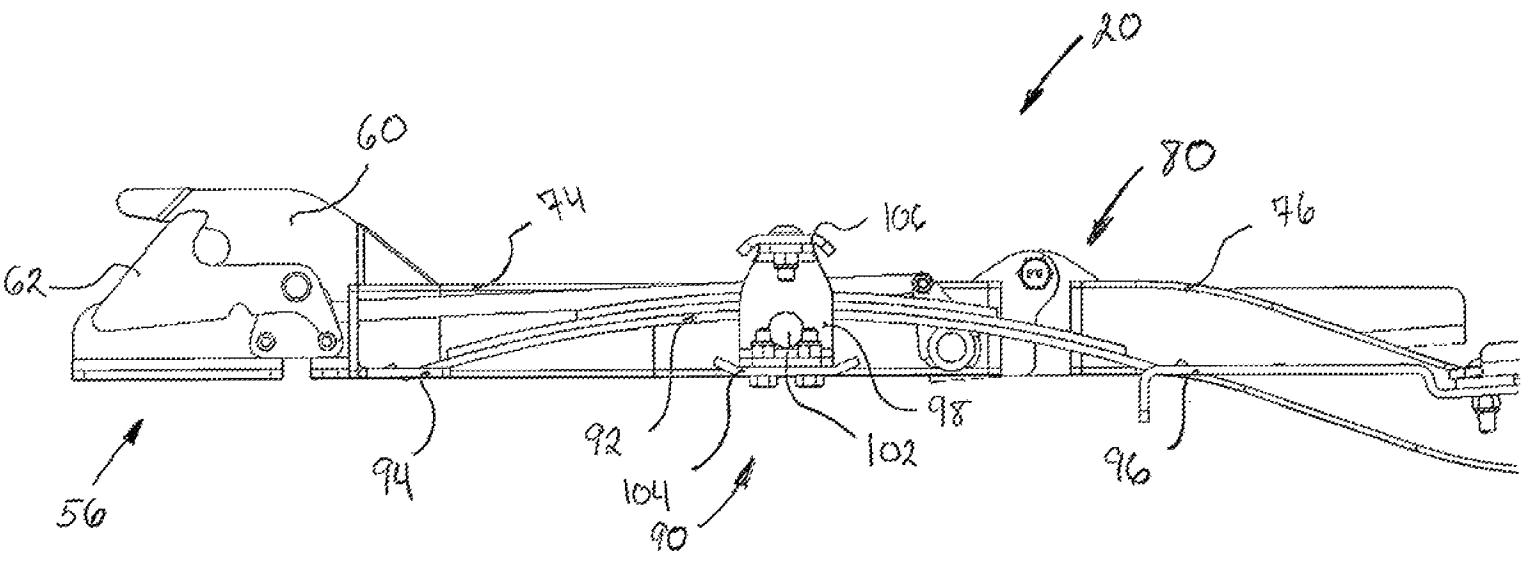
FIG. 4 is a fragmentary side view of the support frame of FIG. 1.
Figure 5:
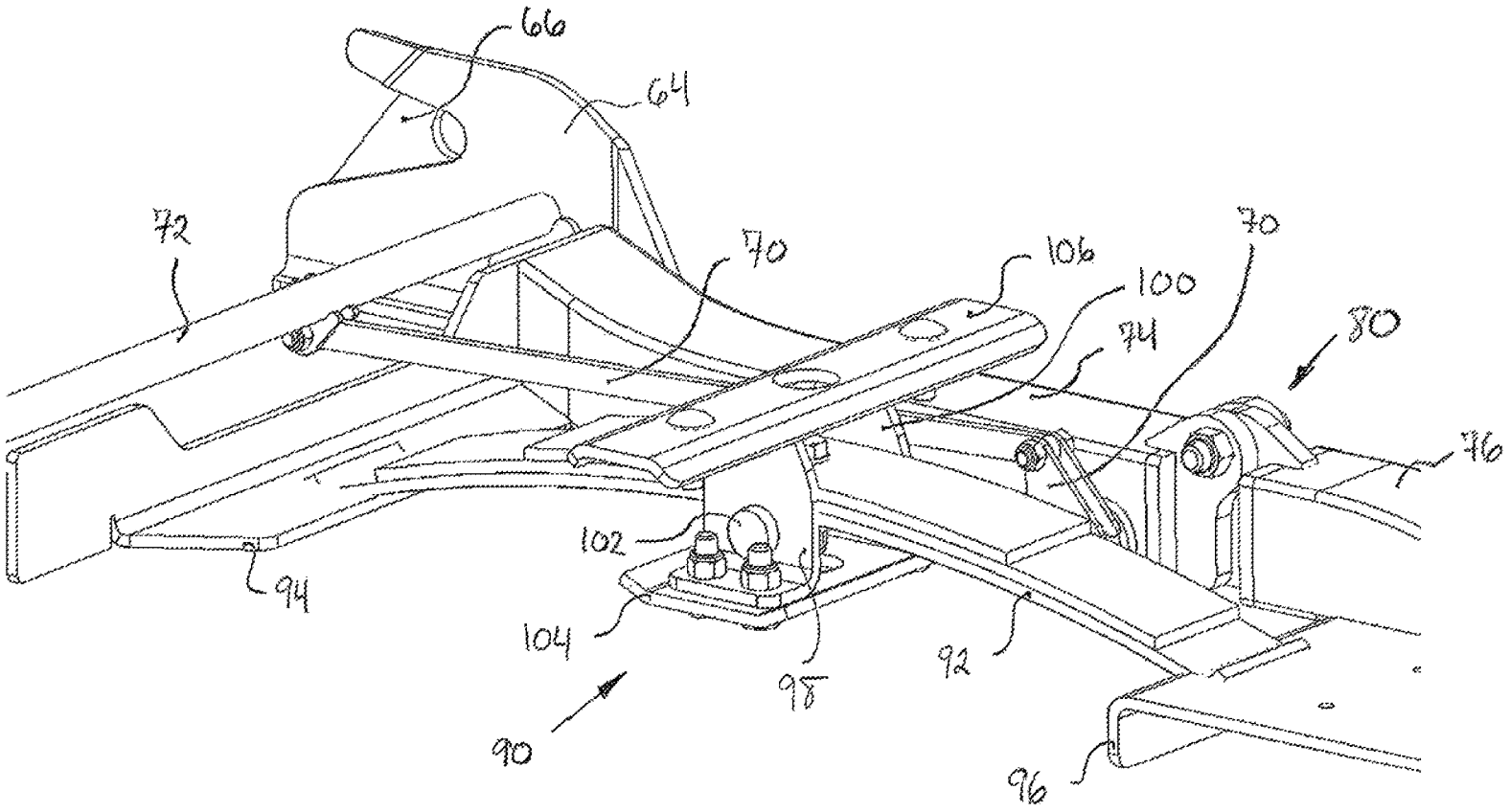
FIG. 5 is a fragmentary side perspective view of the support frame of FIG. 1.

The brackets 98 and 100 are further secured (e.g. fastened, bolted, welded, etc.) to a middle or intermediate supporting member or plate 104 which is itself secured to the rear portion 74 of the support frame 20. As shown in FIGS. 4 to 6, the middle supporting plate 104 is longitudinally located between the rear supporting plate 94 and the front supporting plate 96.

Understandably, in the present embodiment, the load supported by the leaf spring 92 when the front portion 76 is pivoted upwardly with respect to the rear portion 74 is at least partially transferred to the supporting brackets 98 and 100, to the middle supporting plate 104, and thus, to the rear portion 74.

As best illustrated in FIGS. 4 and 5, in the present embodiment, the brackets 98 and 100 also support, in their upper portion, a stopping member or plate (or stopper) 106 which is configured to abut on the underside 14 of the vehicle 10 when the support frame 20 is raised by the winch 18 (see also FIGS. 10B and 10C). Still, in other embodiments, the stopping plate 106 could be mounted elsewhere on the rear portion 74.

In other embodiments, the leaf spring 92 could be differently mounted to the rear portion 74. For instance, in FIGS. 11 to 15, the leaf spring 92 is pivotally mounted to a rod 110, fixedly mounted to the rear portion 74, via a mounting assembly 112. The mounting assembly 112 comprises a top plate 114 and a bottom U-shaped bracket 116 fastened to each other (e.g. with bolts 118 and nuts 120).

Understandably, the biasing assembly 90 can have many different configurations.

Referring now to FIGS. 10A to 10C, the operation of the support frame 20 will be described in details.

As first shown in FIG. 10A, in use, the support frame 20, in its operative position, is pivotally mounted to the frame 12 of the vehicle 10, and more particularly to the mounting rod 16 located underneath the vehicle 10, and the support frame 20 is lowered with the winch 18 such that the plow 26 engages the ground.

When the plow 26 is no longer needed, the support frame 20 is raised with the winch 18 in order to raise the plow 26 from the ground.

As the support frame 20 is raised, the stopping plate 106 ultimately ends up contacting the underside 14 of the vehicle 10 as best shown in FIG. 10B. Understandably, when the stopping plate 106 contacts the underside of the vehicle 10, the rear portion 74 of the support frame 20 cannot be raised any more.

However, as best shown in FIG. 10C and in accordance with the principles of the present invention, since the front portion 76 of the support frame 20 is pivotally mounted to the rear portion 74, the front portion 76 can be further raised as the winch 18 overcomes the downward bias of the biasing assembly 90. Hence, as the winch 18 does overcome the downward bias of the biasing assembly 90, the front portion 76 pivots upwardly with respect to the rear portion 74 which is blocked by the underside 14 of the vehicle 10. This additional upward pivotal movement of the front portion 76 raises the plow 26 further upward, thereby increasing the ground clearance of the plow 26 with respect to the ground (see FIG. 10C).

Understandably, as the plow 26 is needed again, the winch 18 will lower the support frame 20 first from its inoperative position (see FIG. 10C) to its operative position (see FIG. 10B), during which the downward bias of the biasing assembly 90 will close the hinges 78 and 80, and then toward the ground (see FIG. 10A).

By having a second pivoting point located between the rear end 24 and the front end 22, and by allowing the front portion 76 to pivot upwardly with respect to the rear portion 74, the support frame 20 in accordance with the principles of the present invention generally mitigates the problem of ground clearance of underside-mounted implement supporting frames.

Still, it will be understood that the location of the second pivoting point along the support frame 20 will be chosen such as to take into account the configuration of the vehicle 10 and more particularly the position of the mounting of the rear end 24 underneath the vehicle 10 with respect to the front extremity of the vehicle 10.

Now referring to FIGS. 16 to 21, another embodiment of the present invention is illustrated. In this other embodiment, the resilient member resides within the front and/or rear sections, typically within the cavity formed by the walls of the said section. Such configuration favors the protection of the resilient member from hindrances. Such embodiment is more reliable than previously disclosed systems by insuring that ice formation underneath the vehicle will not affect the efficiency of the resilient member. Furthermore, still in accordance to this other embodiment, it is possible to have a plurality of resilient members. Generally, one biasing assembly per arm of the rear or front sections is adequate. Thus, for a support frame having two parallel arms, the support frame could functionally comprise two biasing assemblies, one in either of the parallel arms.

In such an embodiment the support frame 220 comprises a rear portion 274 and a front portion 276 pivotally mounted thereto. In such embodiment, the front portion 276 may pivot upwardly with respect to the rear portion 274 in order to provide greater ground clearance when the implement is in inoperative position.

Figure 17:
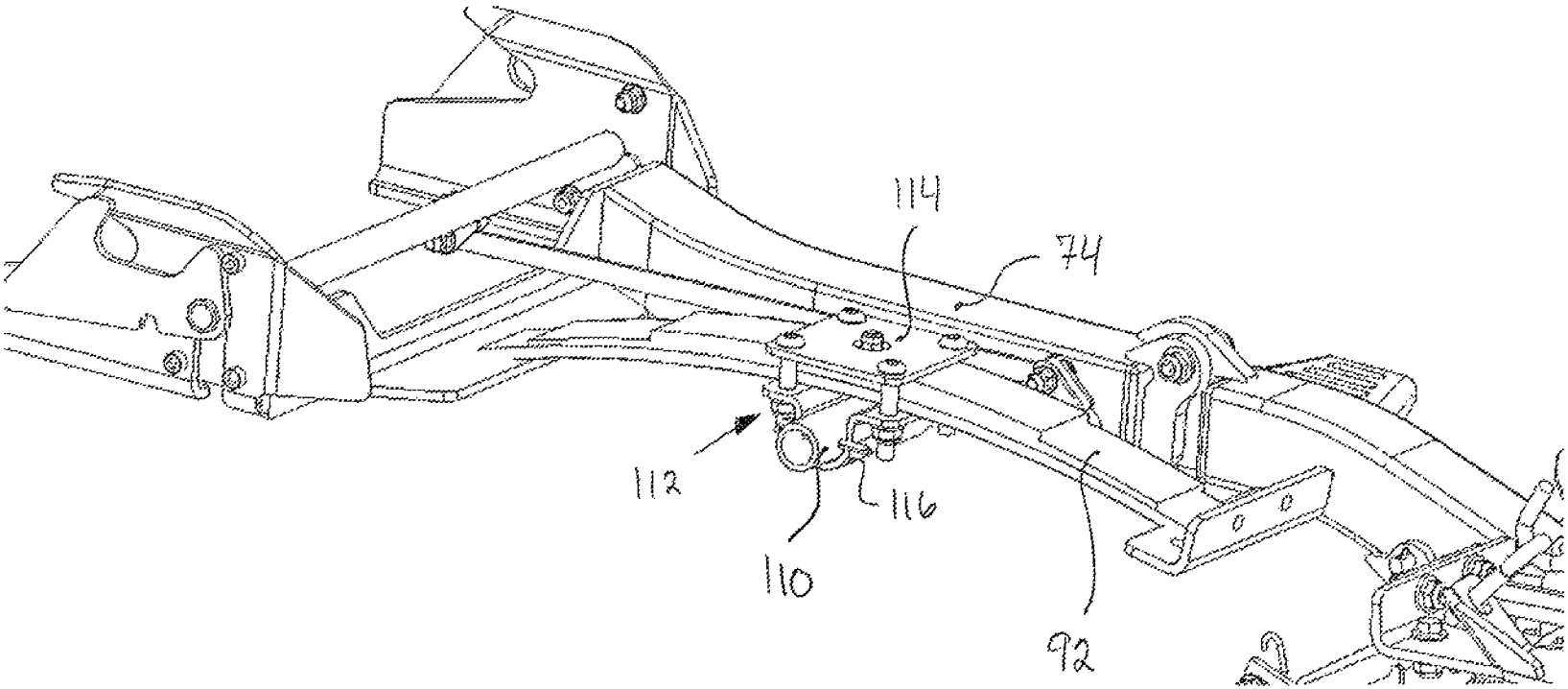
FIG. 17 is a fragmentary side perspective view of the support frame of FIG. 16.
Figure 13:
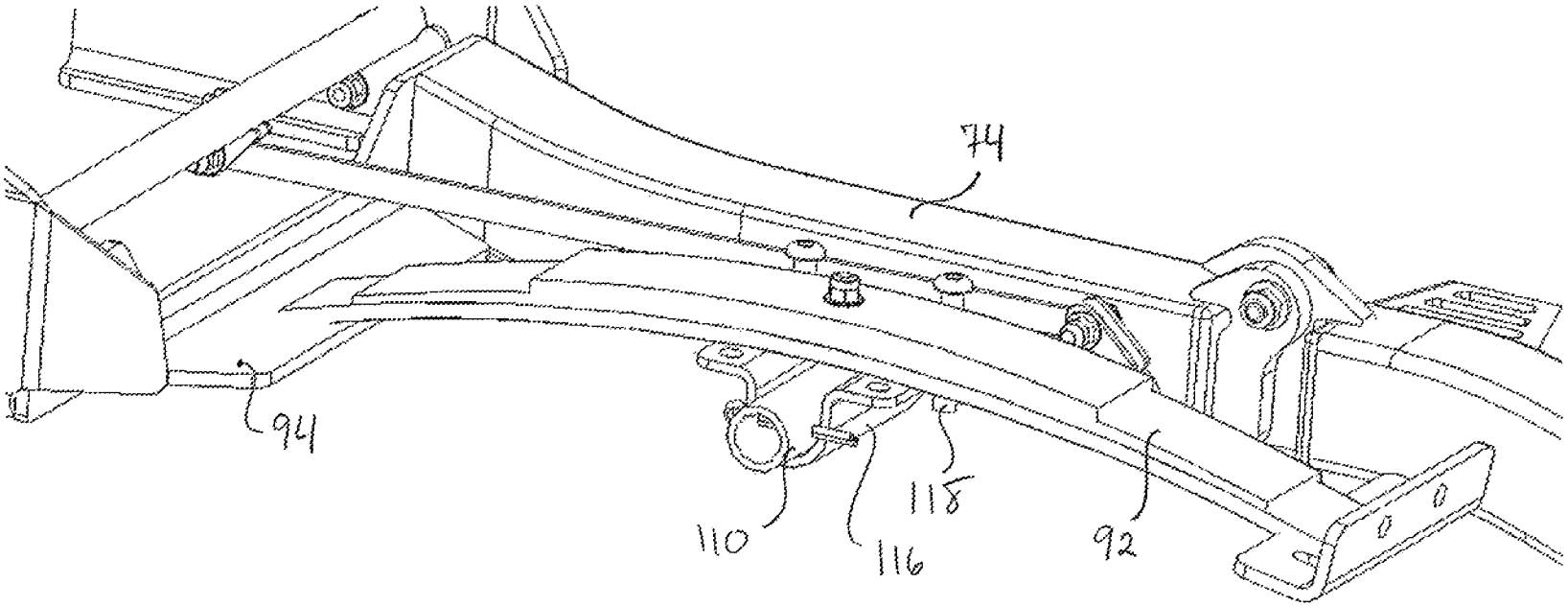
FIG. 13 is another fragmentary side perspective view of the support frame of FIG. 11.
Figure 14:
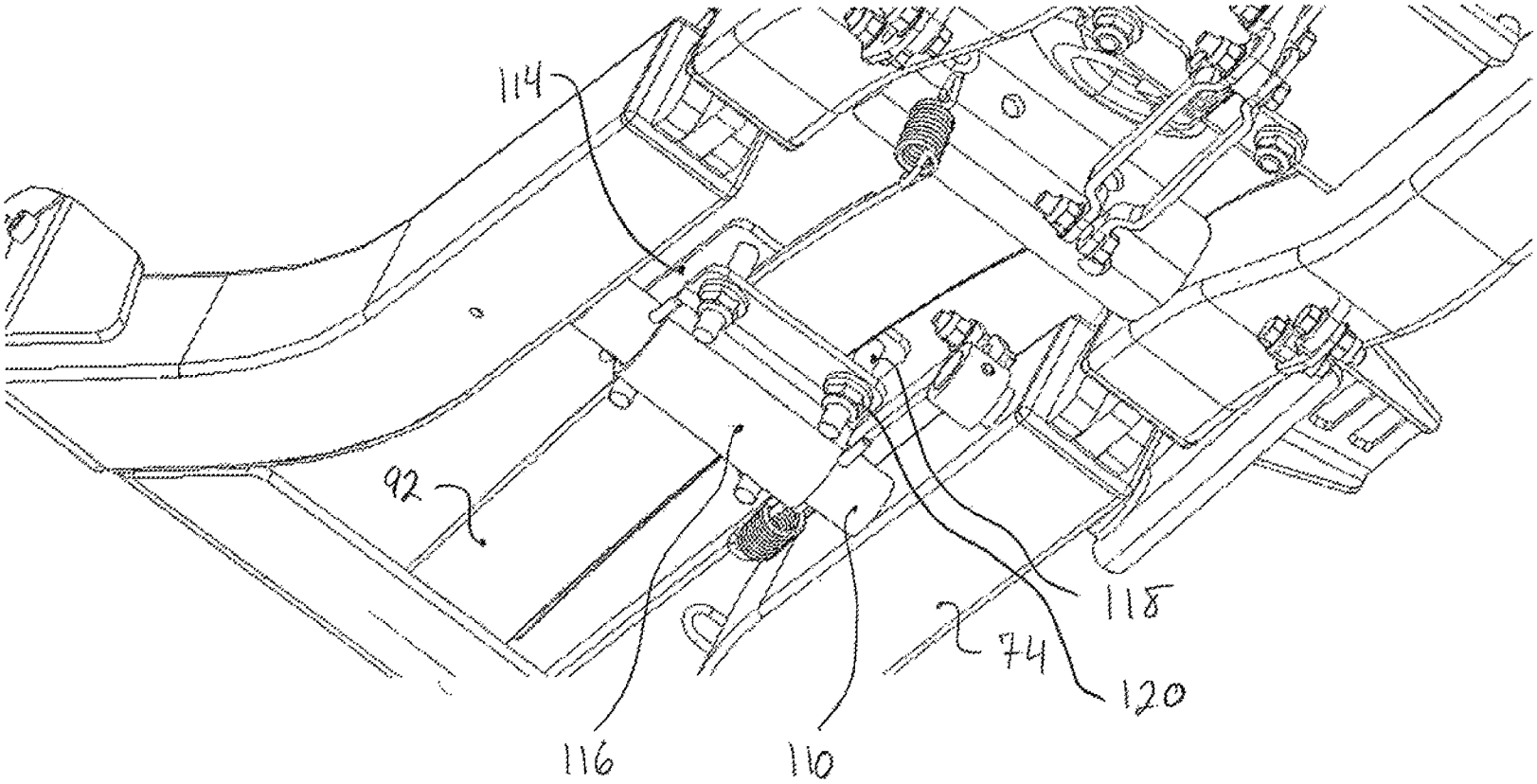
FIG. 14 is a partial bottom perspective view of the support frame of FIG. 11.
Figure 15:
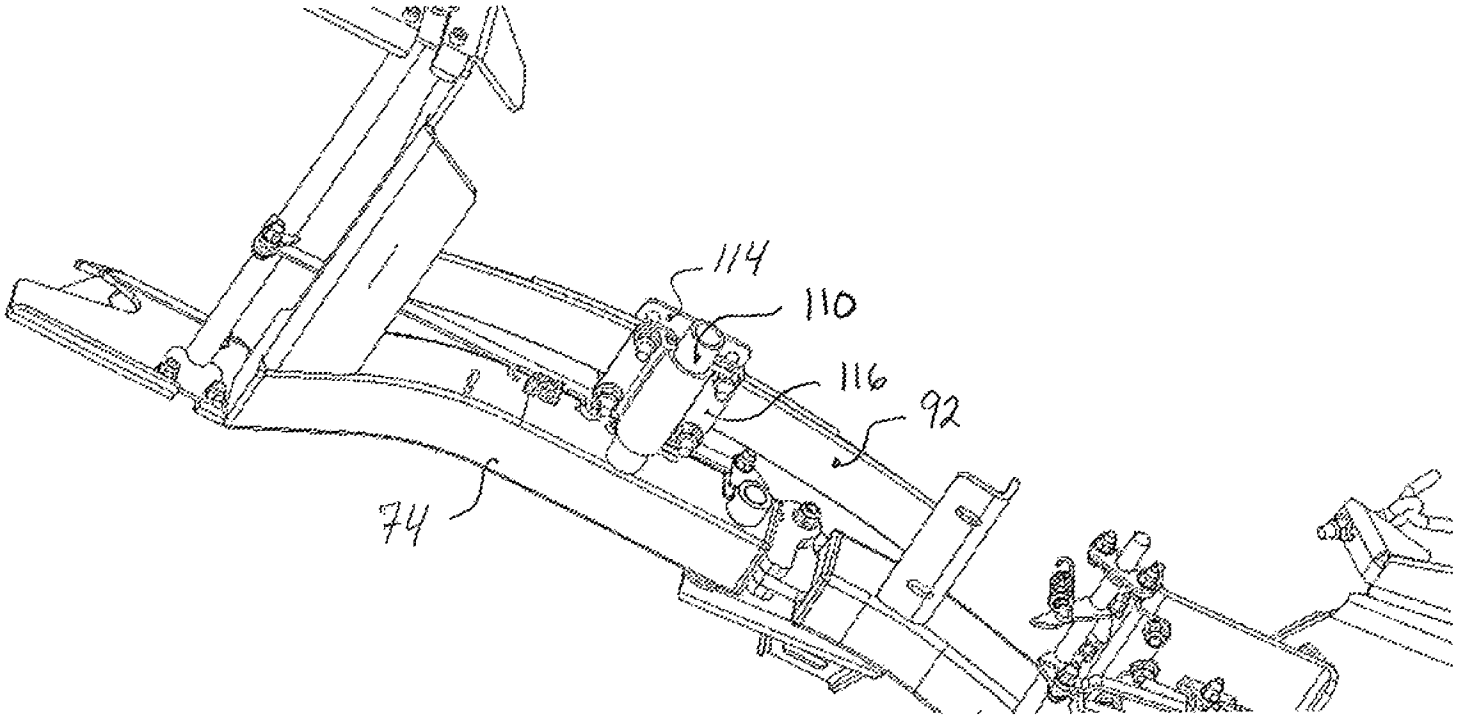
FIG. 15 is a fragmentary partial bottom perspective view of the support frame of FIG. 11.

Now referring to FIG. 17, the rear portion 274 and the front portion 276 are pivotally connected. Typically, the pivotal connection is embodied with a pair of hinges or pivots, 278 and 280 which define a substantially horizontal rotation axis 279 allowing the implement to be raised and lowered. One skilled in the art shall understand that one may use a single hinge or more than two hinges to pivotally connect the rear portion 274 and the front portion 276.

Referring now to FIGS. 17-21, from an operative position of the front portion 276, the hinges 278 and 280 are preferably configured to allow only upward pivotal movements of the front portion 276 with respect to the rear portion 274, i.e. to an inoperative position (see FIG. 8). In that sense, the rotation axis 279 of the pivot point or hinges 278 and 280 is preferably located in the upper portion of the hinges 278 and 280 (more specifically see FIGS. 17 and 18).

Figure 16:
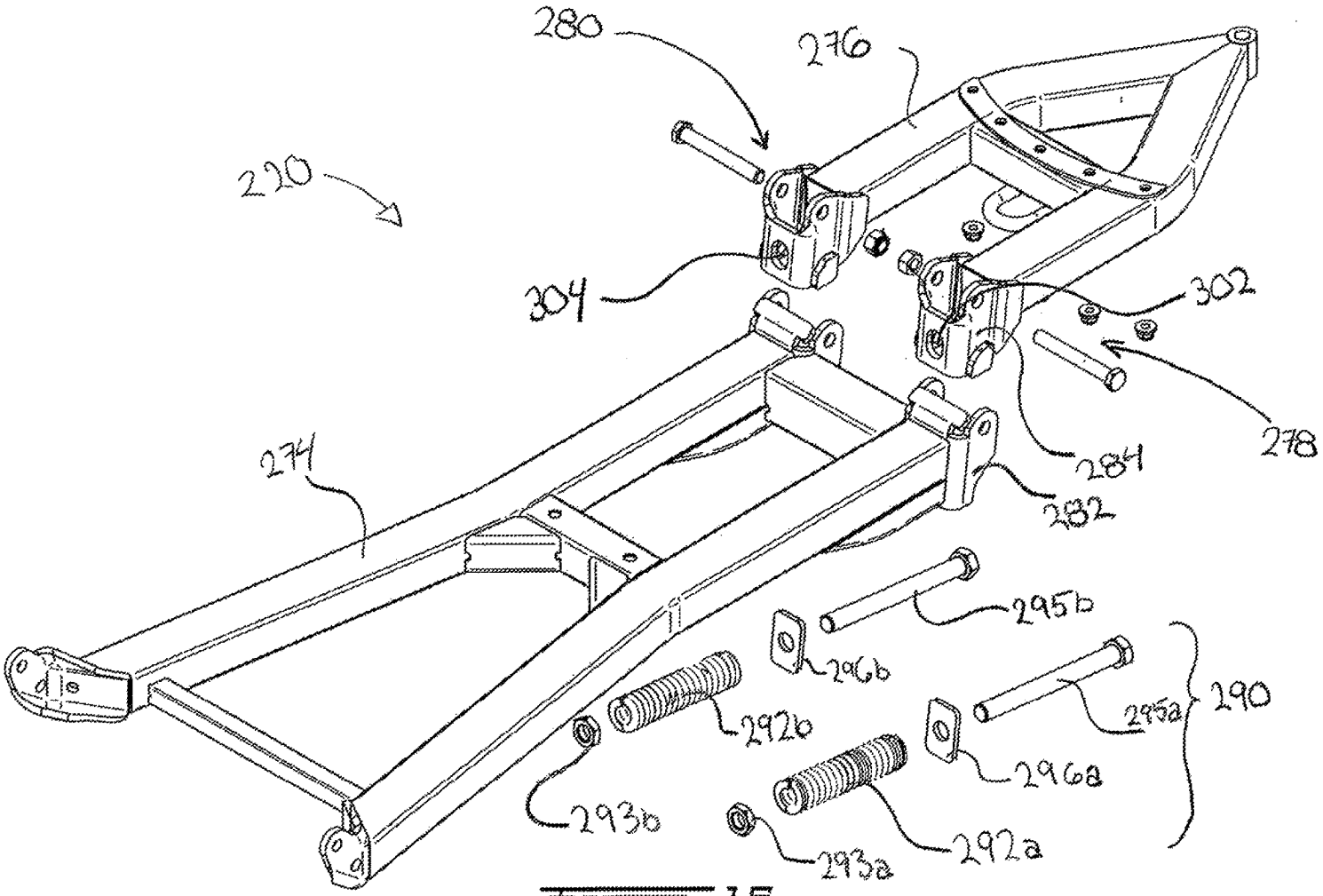
FIG. 16 is an exploded perspective view of another support frame in accordance with the principles of the present invention.
Figure 17:
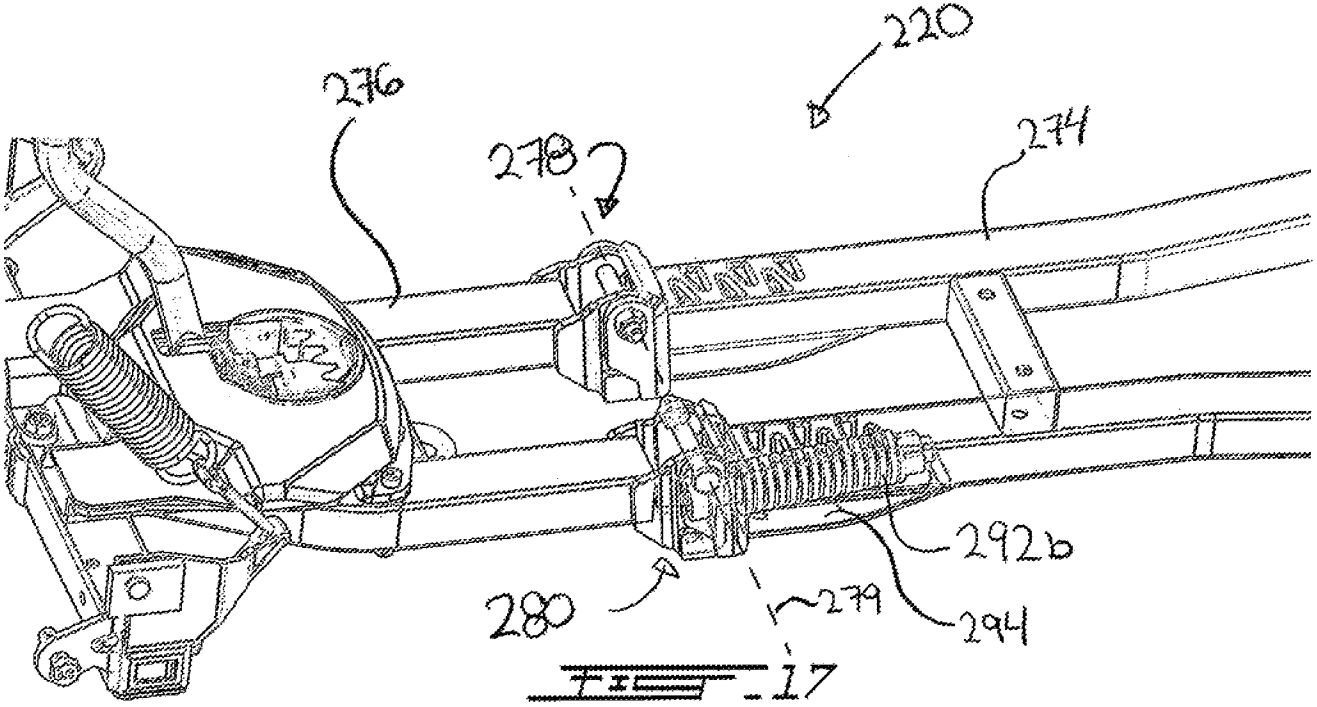
Figure 20:
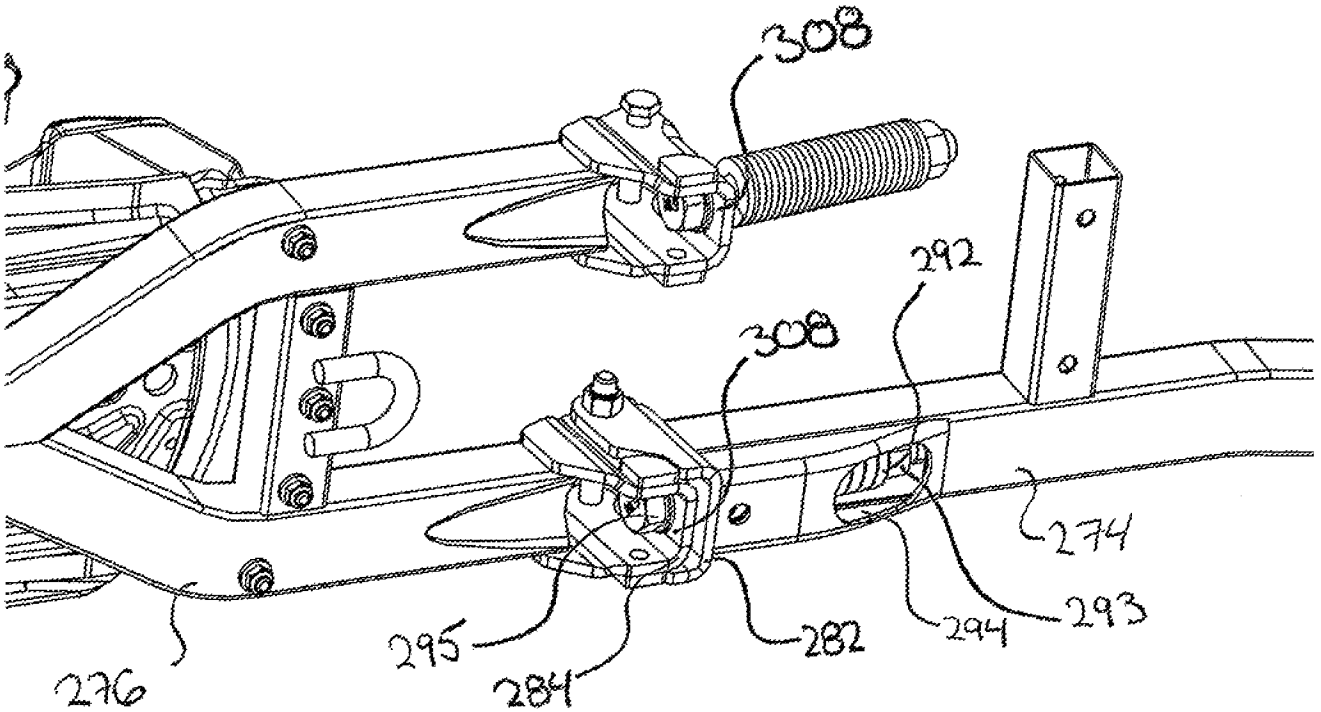
FIG. 20 is another partial perspective view of the support frame of FIG. 16.
Figure 21:
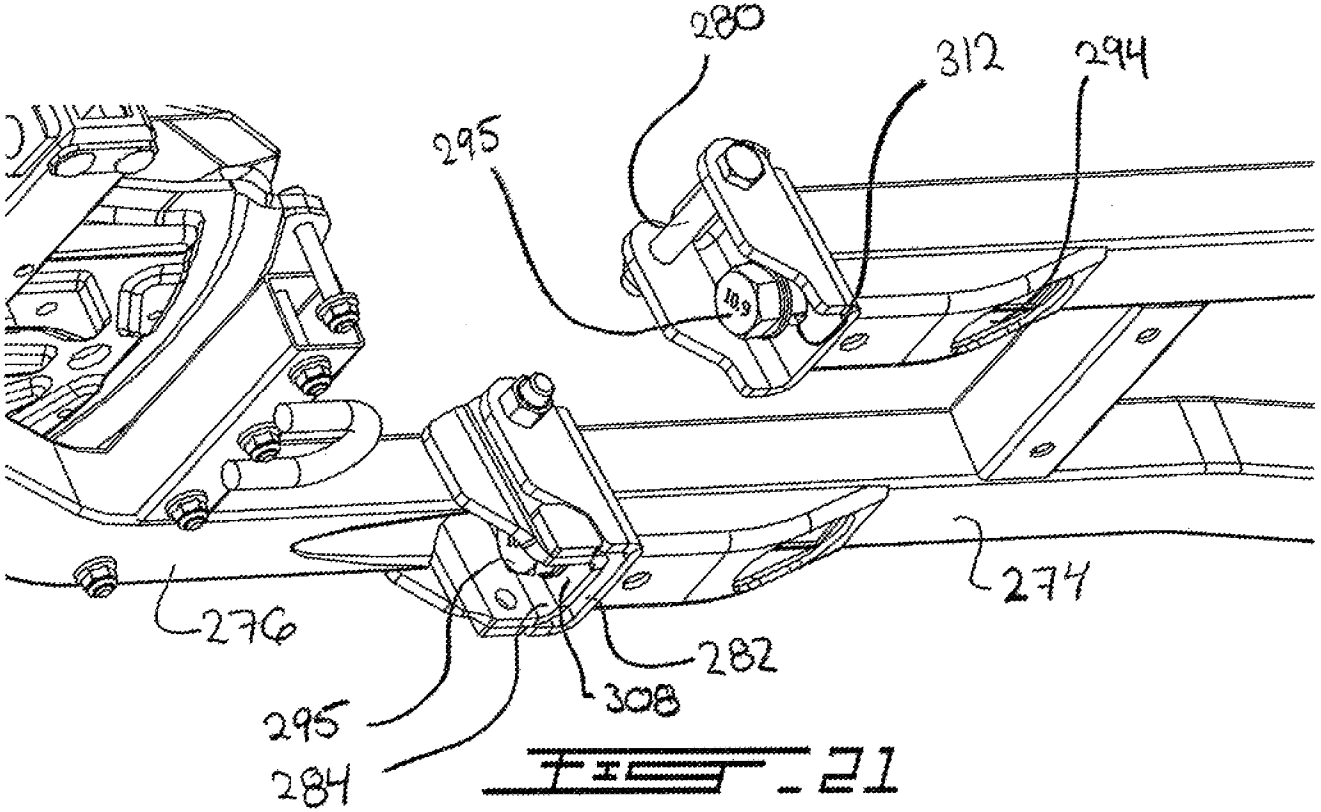
FIG. 21 is another partial perspective view of the support frame of FIG. 16.

Now referring to FIGS. 16, 20 and 21, the hinge 278 comprises complementary hinge members 282 and 284 which are respectively secured to the rear portion 274 and to the front portion 276. In the present embodiment, the hinge member 284 is configured to abut on the rear portion 274 when the hinge 278 is closed and thus when the front portion 276 is in its operative position (see FIG. 20 or 21). Hence, hinge member 284 prevents the front portion 276 from pivoting downwardly further than a predetermined operative position with respect to the rear portion 274. Hinge 280 similarly comprises complementary hinge members 286 and 288 which are respectively secured to the rear portion 274 and to the front portion 276. Hinge 280 functions as hinge 278. One skilled in the art should understand that the hinge member 282, 284, 286 or 288 may be unitary with the rear 274 and/or front 276 portions or may be an extension with the rear 274 and/or front 276 portions.

Figure 18:
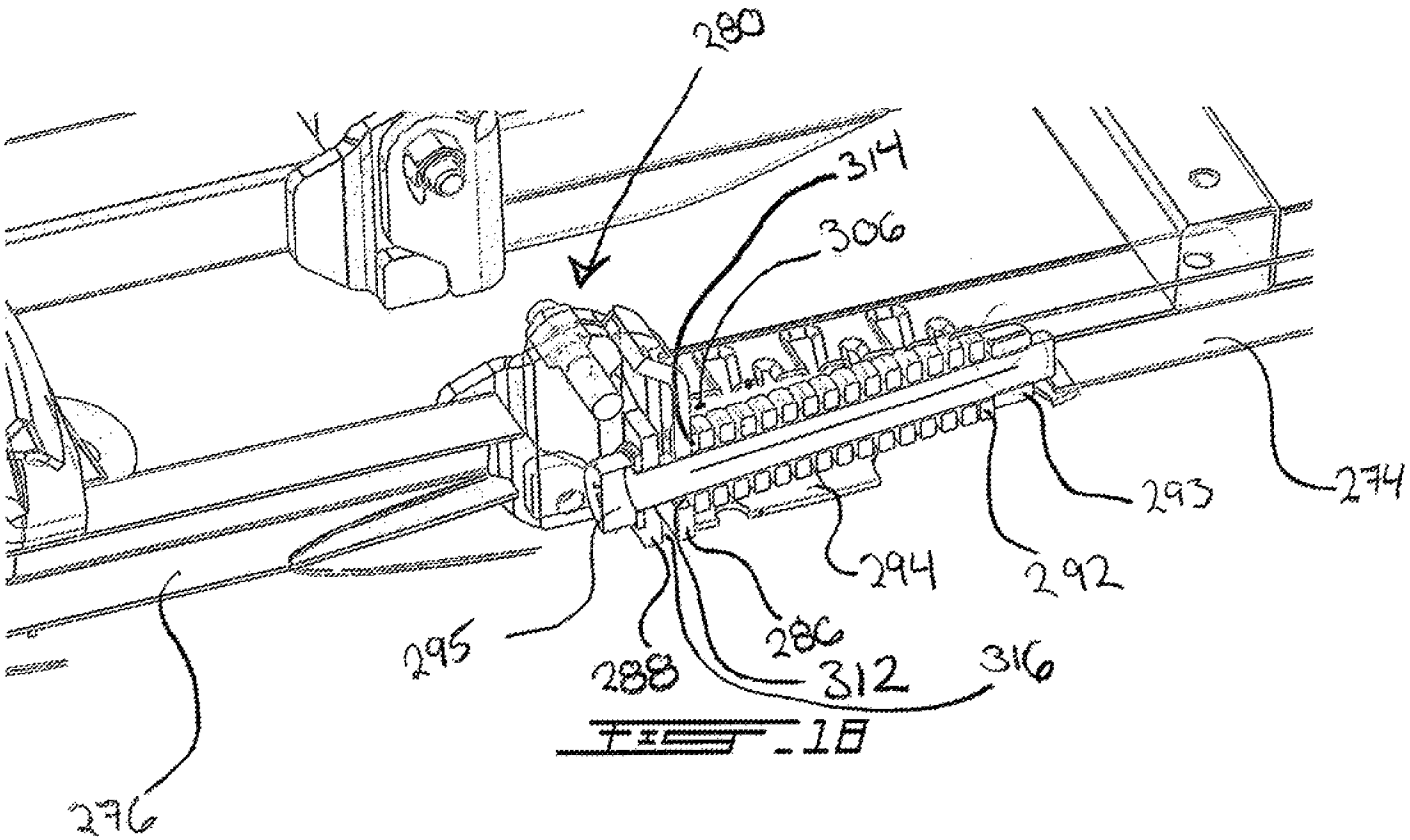
FIG. 18 is a partial perspective view of the support frame of FIG. 16.
Figure 19:
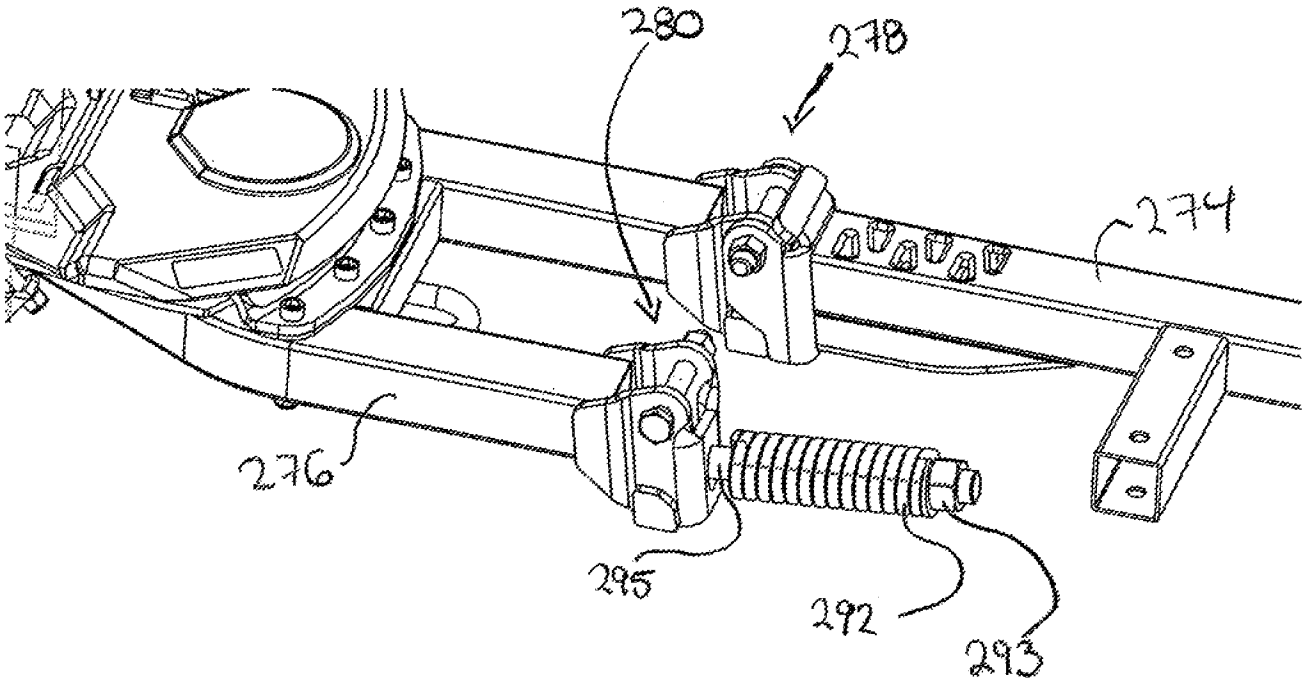
FIG. 19 is another partial perspective view of the support frame of FIG. 16.

Now referring to FIGS. 16 to 18, in order to prevent the front portion 276 from freely pivoting upwardly with respect to the rear portion 274, the support frame 220 comprises at least one biasing assembly 290 which normally biases the front portion 276 in its operative position, i.e. with the hinges 278 and 280 being in closed position.

In the present embodiment, the biasing assembly 290 comprises an elongated member 295*a* or 295*b*, such as but not limited to a rod, bolt or shaft, a resilient member 292*a* or 292*b* such as but not limited to a spring, In a preferred embodiment, the spring may be a coiled spring and a fastener 293, such as but not limited to a bolt or a nut. Additionally, the biasing assembly 290 may comprise a stopping plate or member 296 for retaining the head of the elongated member 295 from crossing the opening 302, 304. Such stopping plate 296 ensures that the biasing assembly 290 is effectively biasing or retaining the front section 276 into an operative position.

The biasing assembly 290 is mounted to the front 276 and rear sections 274. In a preferred embodiment, the biasing assembly generally comprises a coiled spring 292*a*, 292*b* (i.e. a resilient member) which longitudinally extends inside a cavity 294. The said cavity 294 is formed by the walls 306 of the rear section 274. In another embodiment, the biasing assembly 290 could be located in a cavity formed by the inner walls of an arm of the front section 276.

The elongated member 295 comprises a first and a second end and is generally inserted in an opening of the front section 302, 304 (see FIG. 16). In such a configuration, the first end of the elongated member 295, such as the head, abuts on an inside surface 308 of a hinge member 284, 288. The second end of the elongated member 295 is inserted in an opening of the rear section 274. The opening is typically located on the complimentary hinge members 282, 286. Upon insertion of the elongated member 295 in openings 302, 304, 312 of the front 276 and rear 274 sections, the elongated member 295 is inserted in a resilient member 292 secured with a fastener 293 (e.g. a bolt and a nut). Therefore, one extremity of the resilient member 292, is abutting on the inside wall 314 of rear section adjacent to the opening 312 located thereto whereas the other extremity of the resilient member 292 is secured by the fastener 293.

In use, the resilient member 292 biases the front section 276 in the operative position. In other words, the resilient member 292 biases the front 276 and rear 274 sections as to form a substantially horizontal support frame 220. Upon activating of a pulling mechanism, such as but not limited to a winch, the front 276 and rear 274 sections will retain their substantially horizontal alignment until the rear section 274 abut to the underside of the vehicle. At which point the front section 276 will pivot from an aligned position with regards to the rear section 274 to nonaligned position. Such pivoting of the front section 276 away from its original horizontal position will extend the elongated member 295 over a gap 316 formed between the front 276 and rear 274 sections, thus compressing the resilient member 292 between the fastener 293 and the abutting surface 314. Depending on the length of the elongated member 295, pivoting of the front section 276 in the inoperative position may also result in a portion of the elongated member 295 being extended out of the cavity 294.

In the present embodiment, resilient members are coiled springs 292. In other embodiments, the coiled spring 292 could be secured to the elongated member 295 using other method such as, but not limited to, welding. In the present embodiment, the biasing assembly 290 preferably extends from the rear section 274 to the front section 276 beyond a transversal plane defined by the pivot, pivotally connecting the front and rear sections 274 and 276.

Understandably, the biasing assembly 290 can have many different configurations. For instance, whereas the illustrated embodiment depicts a coiled spring being compressed as to apply a bias between the front and rear section, the biasing assembly could alternatively comprises a resilient member in connection to both sections whereas instead of compressing the resilient member, such member would be extended or bent as a way to apply the bias.

Still, this other embodiment may equally use the implements and attachment mechanisms described hereinabove.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A support frame for supporting an implement on a vehicle having an underside, the support frame comprising:

a rear end removably mountable to the underside of the vehicle;

a front end attachable to the implement;

a rear section including the rear end and a front section including the front end, the rear section being pivotally connected via a pivot to the front section, the front section being pivotable with respect to the rear section about the pivot between an operative position in which the implement, when attached to the front end, is in an in-use position, and an inoperative position;

the front and rear sections each having an end portion connected to the pivot, each end portion including longitudinally extending top, bottom and side walls defining an opening therebetween, and a longitudinal cavity extending from the opening between the walls of each of the end portions of the front and rear sections; and a biasing assembly mounted to the front and rear sections biasing the front section into the operative position, the biasing assembly extending through at least one of the openings and longitudinally inside at least one of the cavities of the front and rear sections, and including a resilient member.

2. A support frame as claimed in claim 1, further comprising an abutting surface located at one of the end portions of the front and rear sections; and wherein the abutting surface is adjacent to the pivot, and a first extremity of the resilient member abuts the abutting surface.

3. A support frame as claimed in claim 2, wherein:

at least one of the front and rear sections includes first and second arms;

in the at least one of the front and rear sections including the first and second arms, the end portion is a first end portion and a second end portion, the first arm having the first end portion and the second arm having the second end portion;

the biasing assembly is first and second biasing assemblies;

the first biasing assembly extends longitudinally inside the cavity of the first end portion; and the second biasing assembly extends longitudinally inside the cavity of the second end portion.

4. A support frame as claimed in claim 1, wherein when the front section is in the inoperative position, a portion of the resilient member extends outside the cavity.

5. A support frame as claimed in claim 2, wherein:

the biasing assembly includes a mounting member mounting the resilient member to the front and rear sections;

the mounting member causes abutment of the resilient member to the abutting surface; and the mounting member extends between the rear section and the front section.

6. A support frame as claimed in claim 2, wherein the abutting surface is perpendicular to at least one of the front and rear sections.

7. A support frame as claimed in claim 2, wherein the biasing assembly further includes a rod and a fastener connected to the rod at a second extremity of the resilient member.

8. A support frame as claimed in claim 7, wherein the rod extends past the pivot.

9. A support frame as claimed in claim 7, wherein:

the front and rear sections each include first and second arms;

in each one of the front and rear sections, the end portion is a first end portion and a second end portion, the first arm having the first end portion and the second arm having the second end portion;

the pivot is a first pivot and a second pivot, the first arm of the front section is pivotally connected to the first arm of the rear section about the first pivot, and the second arm of the front section is pivotally connected to the second arm of the rear section about the second pivot; and the biasing assembly is a first biasing assembly and a second biasing assembly, the first biasing assembly extends longitudinally inside the cavity of the first end portions of the front and rear sections, and the second biasing assembly extends longitudinally inside the cavity of the second end portions of the front and rear sections.

10. A support frame as claimed in claim 7, wherein the biasing assembly at least partially extends through a gap formed between the rear and front sections, the gap being formed when the front section pivots with respect to the rear section between the operative and inoperative positions.

11. A support frame as claimed in claim 7, wherein:

the pivot has a pivot axis; and when the front section is in the operative position, the biasing assembly traverses a plane formed by the pivot axis and a vertical axis extending perpendicularly to the support frame.

12. A support frame as claimed in claim 7, wherein the resilient member is a coil spring.

13. A support frame as claimed in claim 2, wherein the support frame further includes a rear attachment mechanism disposed at the rear end for removably mounting the support frame to the underside of the vehicle.

14. A support frame as claimed in claim 13, wherein:

the pivot has a pivot axis; and the rear attachment mechanism allows the support frame to pivot with respect to the vehicle about an axis that is rearward of the pivot axis.

15. A support frame as claimed in claim 13, wherein the rear attachment mechanism includes at least one latch.

16. A support frame as claimed in claim 13, wherein the rear attachment mechanism includes a pair of latches.

17. A support frame as claimed in claim 2, wherein the rear section includes a stop positioned to abut the underside of the vehicle when the support frame is raised.

18. A support frame and implement assembly, comprising the support frame of claim 2, with the implement attached thereto, the implement having upper and lower portions, and wherein the pivot is positioned lower than the upper portion of the implement.

19. A support frame as claimed in claim 2, wherein the support frame includes a front attachment assembly at the front end for mounting the implement.

20. A support frame as claimed in claim 19, wherein the front attachment assembly includes an attachment plate pivotally mounted to the support frame.

21. A support frame and implement assembly as claimed in claim 18, wherein the implement is a plow.

* * * * *